US006073568A

United States Patent [19]

Finley

[11] Patent Number: 6,073,568

[45] **Date of Patent: *Jun. 13, 2000**

[54] BOAT WITH OUTRIGGERS

[75] Inventor: John Finley, Joplin, Mo.

[73] Assignee: Tri-Span, L.L.C., Joplin, Mo.

[ * ] Notice: This patent is subject to a terminal disclaimer.

[21] Appl. No.: 09/201,314

[22] Filed: Nov. 28, 1998

Related U.S. Application Data

[63] Continuation-in-part of application No. 08/914,334, Jul. 14, 1997, which is a continuation-in-part of application No. 08/611,389, Mar. 5, 1996, Pat. No. 5,647,294.

[51] Int. Cl.[7] ..... B63B 1/00

[52] U.S. Cl. ..... 114/61.1; 114/61.16; 114/61.17; 114/123

[58] Field of Search ..... 114/123, 61.1, 114/61.11, 61.15, 61.16, 61.17, 61.18, 61.19, 271, 274, 283, 292

[56] References Cited

U.S. PATENT DOCUMENTS

| | | | |
|---|---|---|---|
| 725,264 | 4/1903 | Von Malein | 114/123 |
| 990,759 | 4/1911 | Maggio | 114/123 |
| 1,710,625 | 4/1929 | Kapigian | 114/123 |
| 2,678,018 | 5/1954 | Crisp | 114/123 |
| 3,276,413 | 10/1966 | Dolph et al. | 114/123 |
| 3,960,102 | 6/1976 | Davy | 114/123 |
| 4,159,006 | 6/1979 | Thurston | 114/123 |
| 4,172,426 | 10/1979 | Susman | 114/61 |
| 4,213,412 | 7/1980 | Jamieson | 114/61 |
| 4,228,750 | 10/1980 | Smith et al. | 114/39 |
| 4,286,533 | 9/1981 | Sanner | 114/39 |
| 4,294,184 | 10/1981 | Heinrich | 114/61 |
| 4,465,008 | 8/1984 | Liggett | 114/39 |
| 4,644,890 | 2/1987 | Lott | 114/61 |
| 4,878,447 | 11/1989 | Thurston | 114/61 |
| 4,898,113 | 2/1990 | Tapley et al. | 114/283 |
| 4,943,250 | 7/1990 | Du Pont | 440/101 |
| 5,107,783 | 4/1992 | Magazzu | 114/61.15 |
| 5,277,142 | 1/1994 | Connor | 114/61 |

OTHER PUBLICATIONS

Deborah Druan, "The Power Trimarans: Ilan Voyager," MULTIHULLS (magazine), Oct./Nov. 1989.

*Primary Examiner*—Stephen Avila
*Attorney, Agent, or Firm*—Jonathan A. Bay

[57] ABSTRACT

A boat has a main hull and a pair of outriggers which extend to distal, capsizing-resistance formations. The capsizing-resistance formations are shaped and arranged such that in contact with the water under forward velocity it provides a generally upward capsizing-resistance force through a given center of action, which force is transmitted by the outrigger to the main hull as an applied capsizing-resistance moment. Given the foregoing, the outriggers position of the capsizing-resistance formations generally outboard and rearward such that said centers of the upward capsizing-resistance force lie spaced substantially outboard or behind a plane containing the stern of the main hull in order to stabilize the fore-to-aft pitching as well as side-to-side rolling of the main boat hull in accordance with boat speed and wave conditions. The capsizing-resistance formations can be either floats shaped and arranged to skim the water surface and provide an upward capsizing-resistance force which comprises a combination of buoyancy and planing forces, or else planes shaped and arranged to plane on the water surface and provide an upward capsizing-resistance force which comprises substantially planing forces, or alternatively asymmetric foils shaped and arranged to plane the water surface or fly if submerged and provide an upward capsizing-resistance force which is alternatively substantially a planing force or hydrodynamic lift.

24 Claims, 16 Drawing Sheets

BOAT WITH OUTRIGGERS

CROSS-REFERENCE TO RELATED APPLICATION

This is a continuation-in-part of Application No. 08,914,334, filed Jul. 14, 1997, which is a continuation-in-part of Application No. 08/611,389, filed Mar. 5, 1996, which is now U.S. Pat. No. 5,647,294.

BACKGROUND OF THE INVENTION

1. Field of the Invention

The invention relates to boat having outriggers. The outriggers extend to distal portions formed as capsizing-resistance formations, alternatively termed stabilizing entities, which are positioned in divergent positions such as simultaneously partly outboard of the central hull's side beam and partly rearward of the central hull's stern, in order to give the boat lateral side-to-side and/or fore-to-aft stability. The capsizing-resistance formations are diminutive relative to the main hull, and are shaped to plane and/or fly through the water in order to give back a moderate capsizing-resistance force. Such a moderate capsizing-resistance force is amplified into a substantial capsizing-resistance moment for the main boat hull if the outriggers are given sufficient extension.

2. Prior Art

Outriggers appear on a variety of water craft, from seagoing canoes to plural-hull vessels such as catamarans, trimarans and the like. Outriggers appear on canoes and plural-hull vessels in various configurations. The basic outrigger configuration on a seagoing canoe comprises a laterally-extending spar cantilevered at one end to the canoe hull, and terminating in an opposite end that supports a float substantially spaced away from the outboard beam of the canoe hull. The outrigger thereby gives the canoe lateral stability not otherwise present.

The configuration of outriggers for trimarans is similar except that an outrigger structure is mounted on each side of a central hull so that the central hull is flanked by a pair of opposite outrigger floats. Examples, among others, are shown by U.S. Pat. Nos. 3,960,102—Davy, and 4,465,008—Liggett. In some catamaran configurations, a pair of laterally spaced floats are interconnected by spars upon which a central deck is elevated off the water. See, for example, U.S. Pat. Nos. 4,286,533—Sanner, and 5,277,142—Connor.

In addition to the above-listed U.S. patent references, further outrigger configurations are shown by U.S. Pat. Nos. 4,159,006—Thurston, 4,172,426—Susman, 4,213,412—Jamieson, 4,294,184—Heinrich, and 4,898,113—Tapley et al. (i.e., on a sail-board).

The above-listed U.S. patent references are alike in disclosing floats which are sized on an equivalent scale as the central or main hull of the craft (i.e. equal to at least one-half of, and usually larger than, the geometry of the central or main hull of the craft). Some of the above-listed U.S. patent references disclose adjustable outriggers, and, of these, most have the floats movably mounted for displacement between an extended-out "use" position and a retracted in "storage" position, as for trailering or docking and the like.

There are shortcoming associated with the prior art outrigger configurations. The bows of the outrigger floats typically plow out spray which can fall back on to the deck of the central or main hull, and thereby soak passengers if the spray is not appropriately shielded or blocked by closed decks and the like. Additionally, the prior art outrigger floats, while typically giving the central or main hull effectively greater lateral (or side-to-side) stability, fail to be configured and positioned in arrangements which would give the central or main hull greater fore-to-aft stability.

Also, none of the prior art outrigger floats are known to be mounted for independent swivelling. They are attached enslaved to the main hull such that during turns the floats cannot take on their own independent heading to compensate for traveling along a different arc from the main hull. What is needed is an improvement in an outrigger configuration which addresses these and multiple other shortcomings with the prior art.

SUMMARY OF THE INVENTION

It is an object of the invention to provide a high speed boat such as a motor boat or the like with improved stability both in the lateral side-to-side direction as well as the fore-to-aft (or front-to-back) direction by means of outrigged stabilizing entities.

It is an alternate object of the invention that the above stabilizing entities are suspended from their spars by a free swivelling mount.

It is an additional object of the invention that the above spars are mounted or "suspension" to/from the boat's main hull by means of a non-rigid suspension. Moreover, it is further desired that the suspension is variable, and allows adjustable tightening or loosening of the suspension of the stabilizing entities.

It is another object of the invention that the suspension of the spars include a mechanism for varying the angle of vertical sweep.

It is a further object of the invention that the suspension of the spars include combined adjustable suspension with varying angle of vertical sweep, as well as varying the angle of horizontal sweep.

It is still a further object of the invention that the stabilizing entities are provided with local propulsion units.

A number of additional features and objects will be apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

FIG. 21 is an elevational view taken in the direction of arrows XXII—XXII in FIG. 20, which shows transverse (relative to the axis of the spar) rocking of the attitude of the stabilizing entity that in this instance produces fore to aft pitching;

FIGS. 23 through 26 are a set of diagrammatic views which show problems with spars angled aft for the case of planing-type main hull which when started from stop is resisted against rearing back to climb up over its bow wave and onto its plane, as well as which set of views show at least one or more solutions thereto in accordance with the invention wherein:

FIG. 23 is a side view of a boat in accordance with FIGS. 13 through 18 wherein the spars are angled aft and the boat is resting stationary;

FIG. 24 is a comparable side view of the boat in FIG. 23 wherein the spars are locked rigid during while the boat is given power and is fighting to squat down as to climb out onto its plane;

FIG. 25 is a comparable side view of the boat in FIGS. 23 and 24 wherein the spar-elevating mechanism is alternatively slackened or else is operated to slightly lift the spars;

FIG. 26 is a comparable side view of the boat in FIG. 25, showing the boat as it is being powered up from stop and while squatting down to climb out onto its plane, wherein the spars in this instance are not fighting the boat from squatting down;

DETAILED DESCRIPTION OF THE PREFERRED EMBODIMENTS

This detailed description is sectionalized into three separately organized sections, wherein section "I" non-exclusively covers the matters shown generally with reference to FIGS. 1 through 5, section "II" non-exclusively covers the matters shown generally with reference to FIGS. 6 through 12, and section "III" non-exclusively covers the matters shown generally with reference to FIGS. 13 through 28*b*.

I

Figure 1:
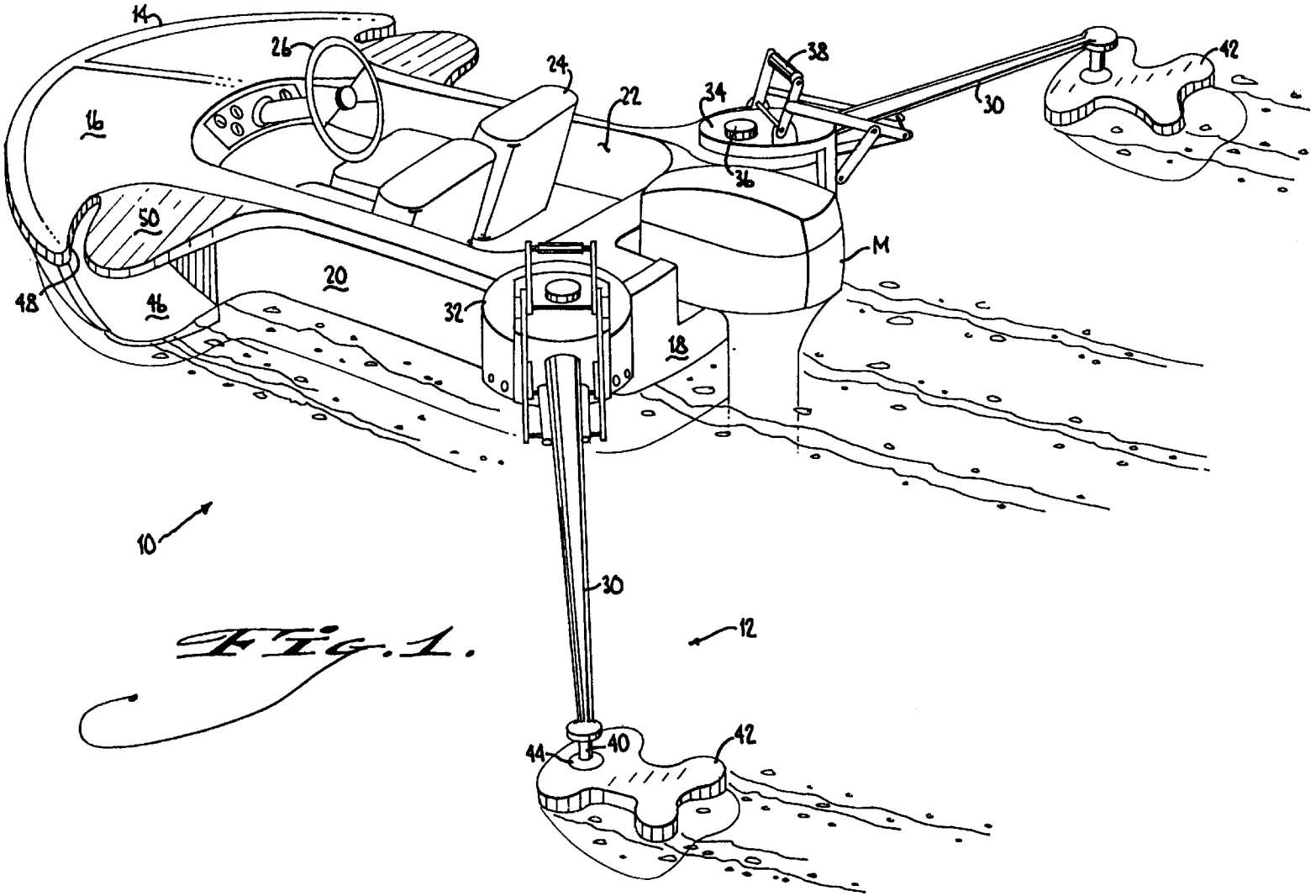
FIG. 1 is a perspective view of a boat with adjustable outriggers in accordance with the invention.
Figure 2:
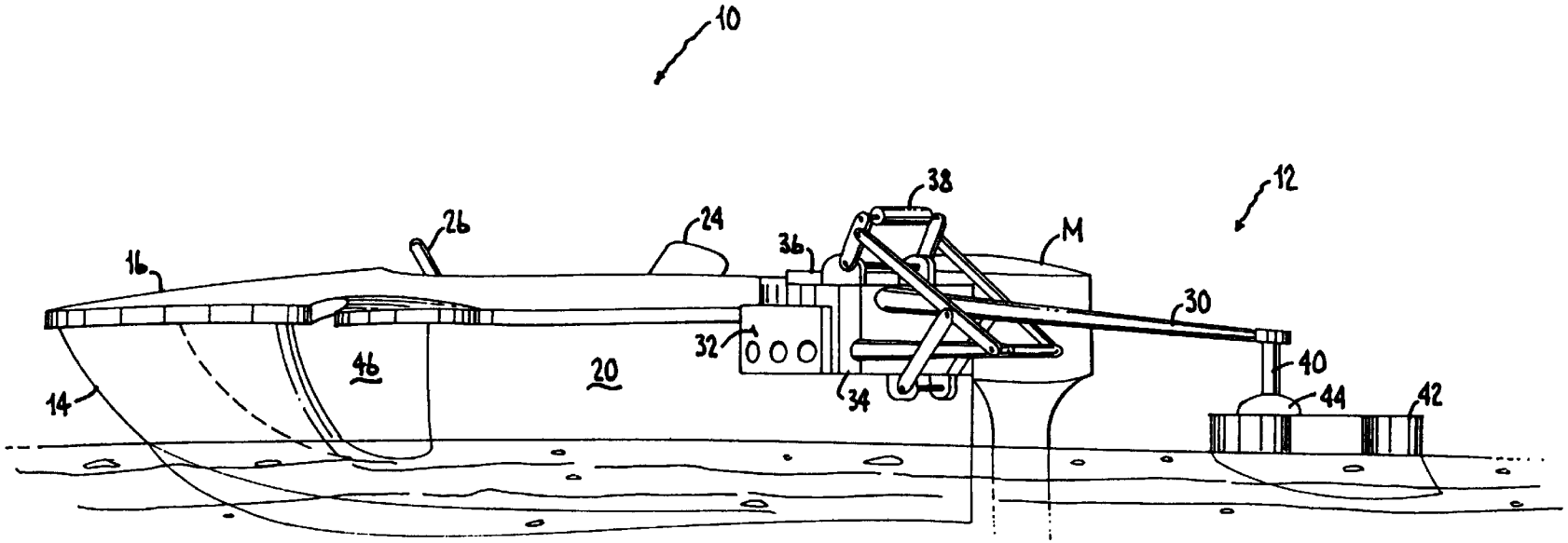
FIG. 2 is a side elevational view thereof.
Figure 3:
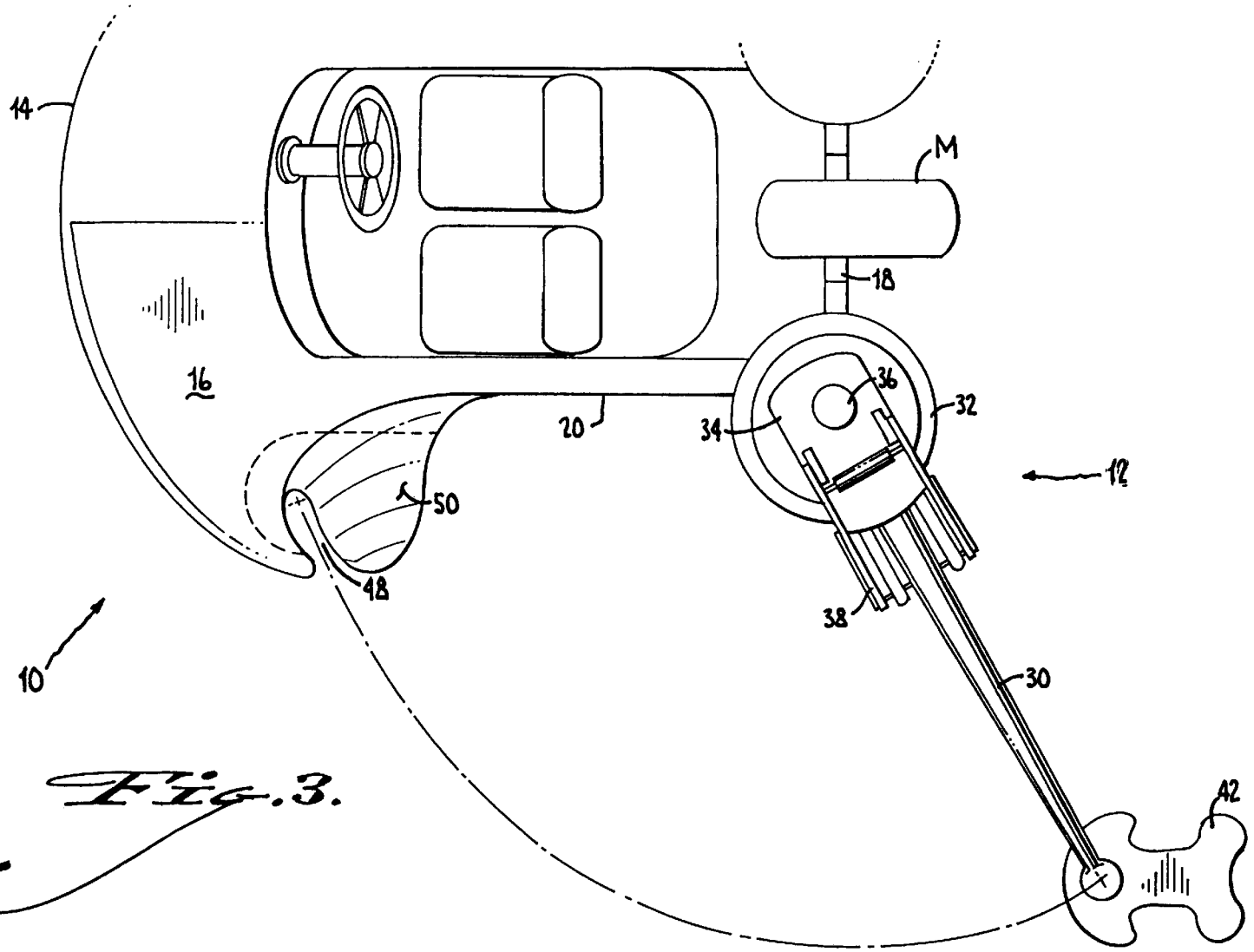
FIG. 3 is a top plan view thereof, with portions broken away.

In FIGS. 1 through 3, a boat 10 with adjustable outriggers 12 in accordance with the invention is shown powered by an outboard motor M. In the drawings, the boat 10 is a motor-propelled boat. However, the adjustable outriggers 12 in accordance with the invention can be deployed on other water craft as well and, accordingly, the depiction and description here of a motor-propelled boat is used merely for convenience in this specification and does not limit the invention.

The boat 10 comprises a central or main hull 14 having an enlarged bow 16, an enlarged stern 18 across the middle of which the motor M is mounted, and a necked-in intermediate portion 20 extending between the bow 16 and stern 18. The main hull 14 also has a passenger compartment 22 carrying a pair of passenger seats 24, and a steering wheel 26 which, along with other accessories (not shown), are customary on motor-powered boats of this type.

The preferred configuration of this boat hull 14 (i.e., excluding the outriggers 12 and motor M) is given a bow-to stern length of about 12 feet (3.6 m) and a beam-to-beam width of about 5 feet (1.5 m). The boat 10 preferably retains this size when the outriggers 12 are fully swung forward in the extreme forward position (i.e., the "storage position, not shown). This would be advantageous for various purposes, such as, for example, for more convenient trailering over the roadways or for passage through narrow inlets, and the like. Additionally, the boat 10 (including the outriggers 12 but excluding the motor M) preferably weighs generally between 200 and 250 pounds (90 and 115 Kg) for convenience of hoisting up off the water or towing in the water, as a dinghy, as to service a larger craft. The preferred utility for the boat 10 would include duties as a seagoing fishing boat with capabilities of squeezing through narrow inlets (with the outriggers stored) as well as negotiating moderately swelling seas at open speeds (with the outriggers deployed in "use" positions as shown).

One inventive aspect here concerns the outriggers 12. There are two opposite outrigger spars 30 mounted on the left and right extreme rear corners 32 of the boat hull 14. These corners 32 are given at least a semi-circular turret shape and carry swivel-mounted brackets 34 in which the outrigger spars 32 are securely cantilevered. The swivel-brackets 34 are attached to the turret corners 32 via swivel pins 36. The swivel-brackets 34 include locking mechanisms 38 which will be more fully described below.

The spars 30 are given a cross-sectional shape of a tear-drop, as is usually seen in sail-boat masts, to reduce drag through the air and/or water while moving forward. Each spar 30 extends to a terminal end that carries a down-link 40 that connects to a float 42. Each down-link 40 terminates, at its lower end, in a ball structure to insert in a complementary socket structure in the float 42 to form a ball-and-socket joint 44 between the down-link 40 and the float 42.

As shown better by FIG. 3, each float 42 has plan-view profile that mimics the plan-view profile of the boat hull 14 except for being a smaller scale version. The socket structure 44 that is formed in the float 42 is located on the axis of symmetry of the float relative to side-to-side symmetry thereof, but otherwise is located relatively forward of the center of geometry of the float's plan-view profile. FIG. 2 shows the appearance of the floats 42 (left side only shown in FIG. 2) in respect of their side-view profile. From the side-view vantage point, the floats 42 are relatively deep or thick. This gives the floats 42 increased buoyancy or flotation so that they won't easily sink or plow deeply into oncoming waves when moved forwardly at the open speeds of the boat 10.

With general reference again to FIGS. 1 through 3, the outrigger spars 30 are about 8 feet (2.4 m) long. If the outriggers 12 are positioned to extend straight out from the sides of the boat hull 14 (such extension not shown), the floats 42 would be spaced about 21 feet (6.4 m) apart. As shown in FIGS. 1 through 3, the outriggers 12 are positioned to form a tripod arrangement among the floats 42 and main hull 14. This is a preferred arrangement for the purpose of at least keeping the spray that the floats 42 plow up from coming back onto the passengers in the passenger compartment 22. The tripod arrangement also gives other advantages too. The tripod arrangement acts to dampen not only the lateral or side-to-side rolling of the main hull 14, but also fore-to-aft pitching. Put differently, the tripod arrangement increases not only the lateral stability of the boat hull 14, but also the front-to-back stability as well.

The outrigger spars 30 can be made of any suitable material, such as aluminum or a polymer or resinous material, so that the spars 30 can deflect upwardly or downwardly when the main hull 14 rolls. The quality and quantity of deflection that is designed into the spars 30 is chosen to optimize the rolling and pitching stability of the main hull 14. When the main hull 14 rolls, it acts to sink or depress one float 42 deeper into the water while simultaneously acting to lift the other float 42 out of the water. If the spars 30 are too stiff, the rolling hull 14 will achieve the undesirable result of just that, i.e., sinking one float 42 while lifting the other. This would be undesirable because the main hull 14 would experience great drag from the sunken float 42 while feeling effectively no drag from the elevated float 42. Then the main hull 14 would be pulled or turned in the direction of the sunken float 42.

When the spars 30 are designed to deflect or yield properly when the main hull 14 rolls, one float 42 would merely be depressed slightly deeper into the water while the other float 42 would ride relatively shallower, but there would not be as great as a difference between the two drag forces that the floats 42 impart to the main hull 14. That way there would not be as much of an imbalanced force that would pull the steering of the main hull 14 in one direction or the other.

Another inventive aspect here concerns the shape and arrangement of the bow 16 of the main hull 14. It includes a pair of inboard recesses 46 configured to store the floats 42 when swung forward to the fully retracted "storage" position (not shown). That is, the spars 30 can be swung forwardly until the floats 42 come to nest in their respective recesses 46. The recesses 46 are configured to fit closely against the floats 42 on at least four sides, which four sides would be—if the floats 42 are likened to a six-sided cube for descriptive purposes only—namely, the upper and lower sides, and the forward and inboard sides. The recesses 46 are open on the outboard and rearward sides of the floats 42. The enlarged bow 16 is given such a shape as shown to shroud the floats 42 when they are stored (not shown). The recesses 46 are preferably open in the rearward area to avoid catching and plowing water when the floats 42 are deployed in "use" positions (i.e., exemplary "use" positions are shown by FIGS. 1 through 3).

The boat hull 14 includes opposite arcuate slots 48 above the recesses 46 to allow the removable passage of the down-links 40 when the floats 42 are either swung in or out of the recesses 46. Portions 50 of the top surface of the boat hull 14—which portions 50 are aft of the arcuate slots 48—are beveled to function as cam surfaces upon which the spars 30 ride when the floats 42 are swung in and out of the recesses 46. The bevel or cam surfaces 50 particularly coact with the spars 30 to ease the alignment of the down-links 40 with the slots 48 and/or ease the alignment of the floats 42 in the recesses 46 when a user is attempting to store and nest the floats 42 in the recesses 46.

Figure 4:
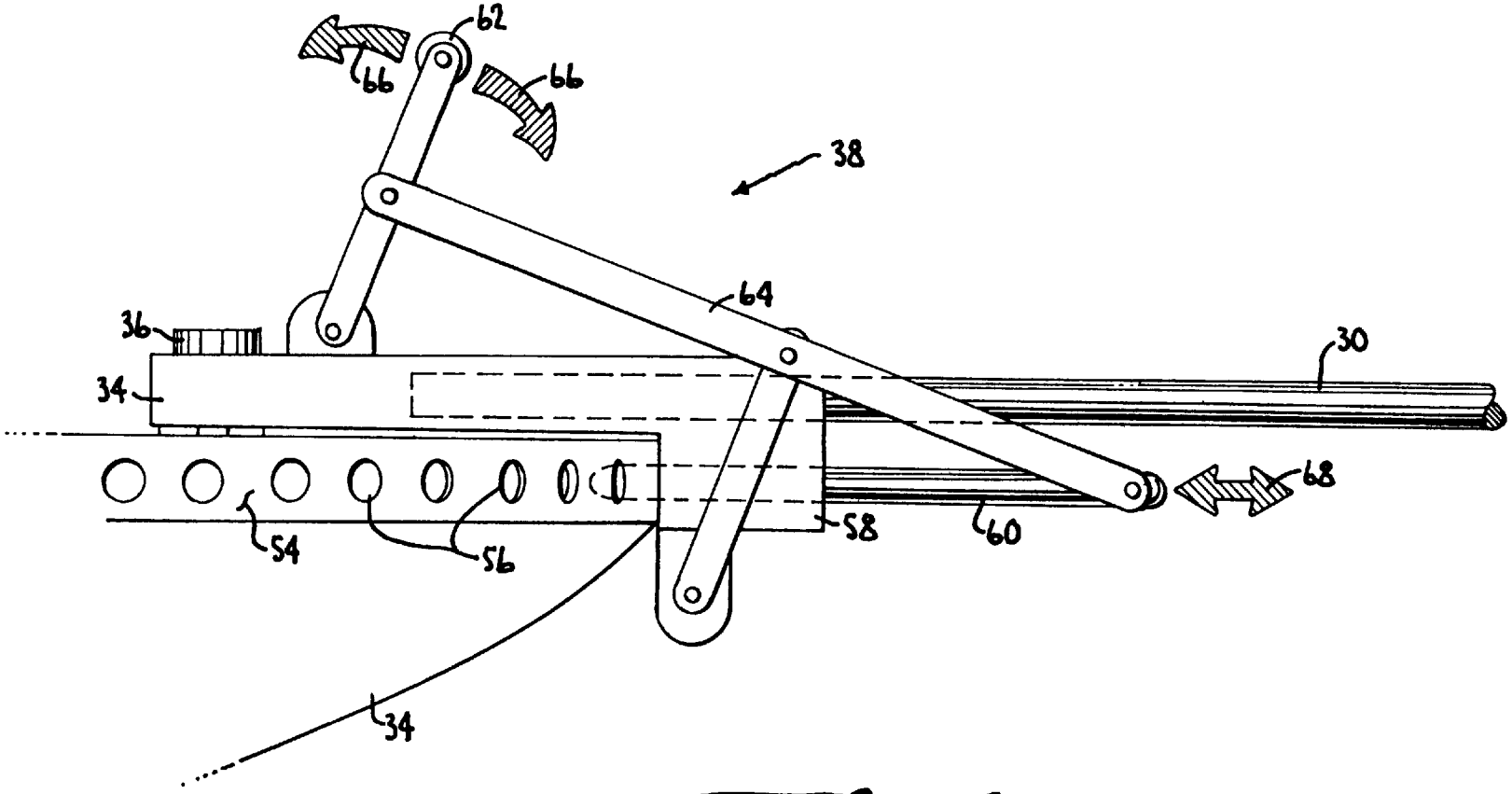
FIG. 4 is an enlarged scale elevational view taken in the direction of arrows IV—IV in FIG. 3.
Figure 5:
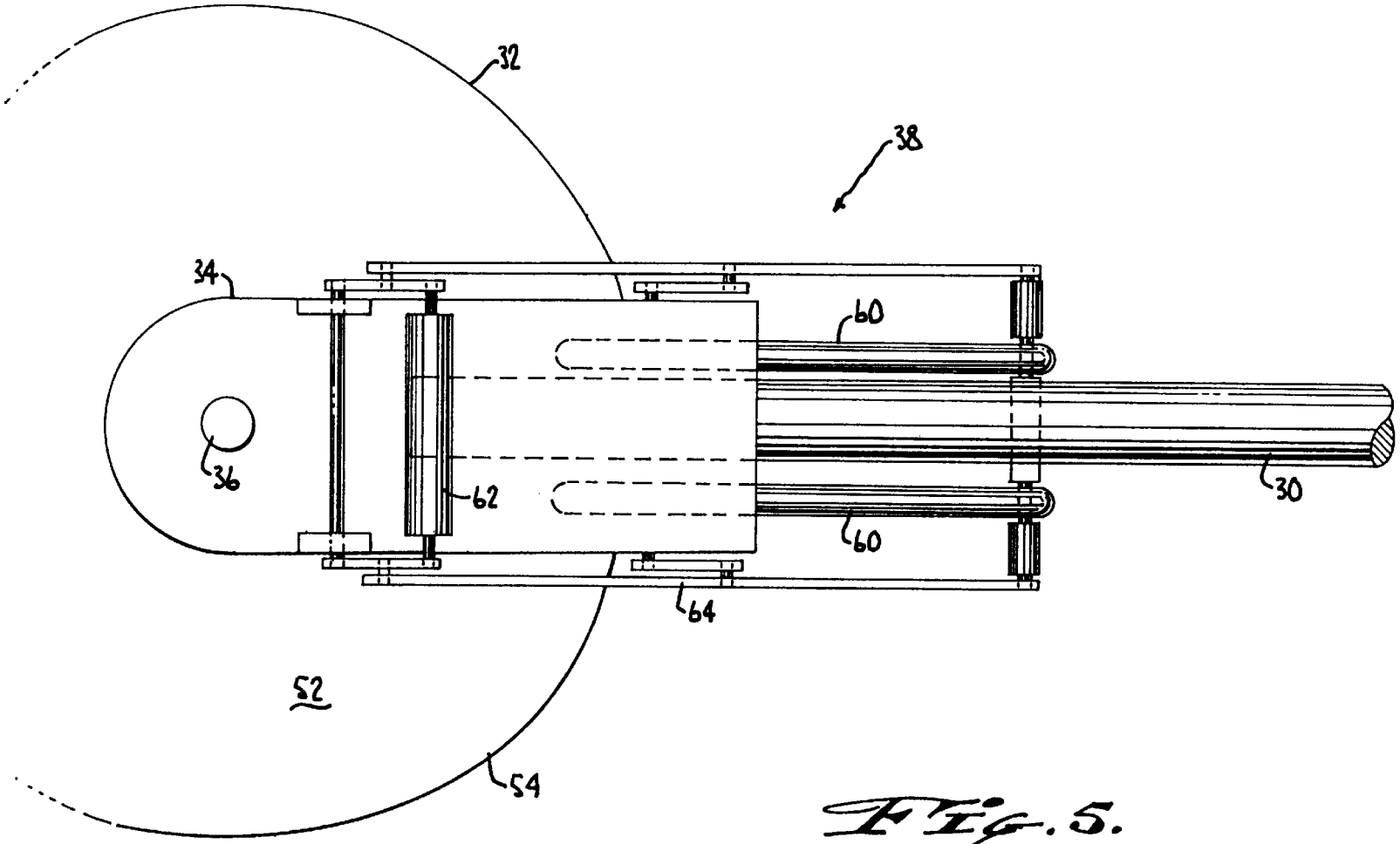
FIG. 5 is a top plan view of FIG. 4.

A further inventive aspect here relates to the cooperation between the swivel-brackets 34 and the turrets 32, as is better shown by FIGS. 4 and 5. The opposite turret structures 32 (left side only shown in FIGS. 4 and 5) define at least a semi-circular flat top 52 delimited by a cylindrical hoop of an edge 54 in which are formed a series of holes 56 (see FIG. 4) spaced every 10° apart between centers. The swivel-bracket 34 is attached to the turret structure 32 by the swivel pin 36 that protrudes up from the axial center of geometry of the turret structure 32. The swivel-bracket 34 extends to terminate in a skirt portion 58 (see FIG. 4) which closely conforms to the hoop edge 54 of the turret structure 32. The swivel-bracket 34 carries the locking mechanism 38 which includes a pair of spaced locking pins 60 for reversibly inserting in any given pair of two holes 56, but which pair of holes 56 are spaced apart by an unused hole 56 immediately therebetween (the arrangement of the two pins 60 being so spaced as to align with two holes 56 spaced by another hole 56 is not shown).

As FIG. 4 shows, the locking pins 60 are actuated by a hand-crank 62. There is a system of actuating links between the hand-crank 62 and the locking pins 60, which links, together with the hand-crank 62, form a four-bar linkage 64. This particular configuration of a four-bar linkage is known in standard reference books as a "D-drive linkage." See, e.g., D. C. Greenwood, ed., "ENGINEERING DATA FOR PRODUCT DESIGN," McGraw-Hill Book Co., 1961, p. 323. An aspect of this linkage configuration 64 is that a given circular input motion (e.g., as indicated by arrows 66 in FIG. 4) is If converted into a linear output motion (which is indicated by arrow 68 in FIG. 4). Given the foregoing description of the turret structure 32 and swivel-bracket 34, the spars 30 can be locked in various positions in 10° increments between extreme positions of straight forward and straight rearward (or further), which extreme positions are at least 180° apart.

A still further inventive aspect here is that the spars 30 are independently adjustable. That way, if the prevailing direction of the waves on the sea is from a side of the boat 10, the leeward float 42 can be positioned relatively more straight out from the side of the main hull 14 while the windward float 42 can be positioned relatively more rearwardly. Other arrangements are possible too and would be indeed more preferable for other situations.

Advantages of the invention include the following. The inventive outriggers 12 are adjustable to positions where they not only dampen the rolling of the main hull 14, but also act to dampen the fore-to-aft pitching. To do this, the outriggers 12 can be placed in positions to increase side-to-side stability as well as front-to-back stability. Therefore, the outriggers 12 effectively give the main hull 14 the stability of a craft that has a comparably greater width and length. Also, the two outriggers 12 are much more adjustable than previous configurations, and are independently adjustable as well. Furthermore, the floats 42 can be set in positions where the spray that they plow up does not fall into the passenger compartment 22. This advantage is particularly acute for relatively fast, motor-powered boats, but would be advantageous also for sail-craft too. Additionally, the outrigger spars 30 are given such flexibility so as to reduce the pull on the main hull 14 that results when one float 42 is sunk much deeper in the water than the other. And—whereas this list of advantages is not exhaustive—another advantage given by the invention is the location of the down-link 40 connection 44 on the float 42. It is located forward of the center of geometry of the float 42. That arrangement promotes better parallel alignment of the long axis of the float 42 with the direction of travel of the main hull 14.

II

Figure 6:
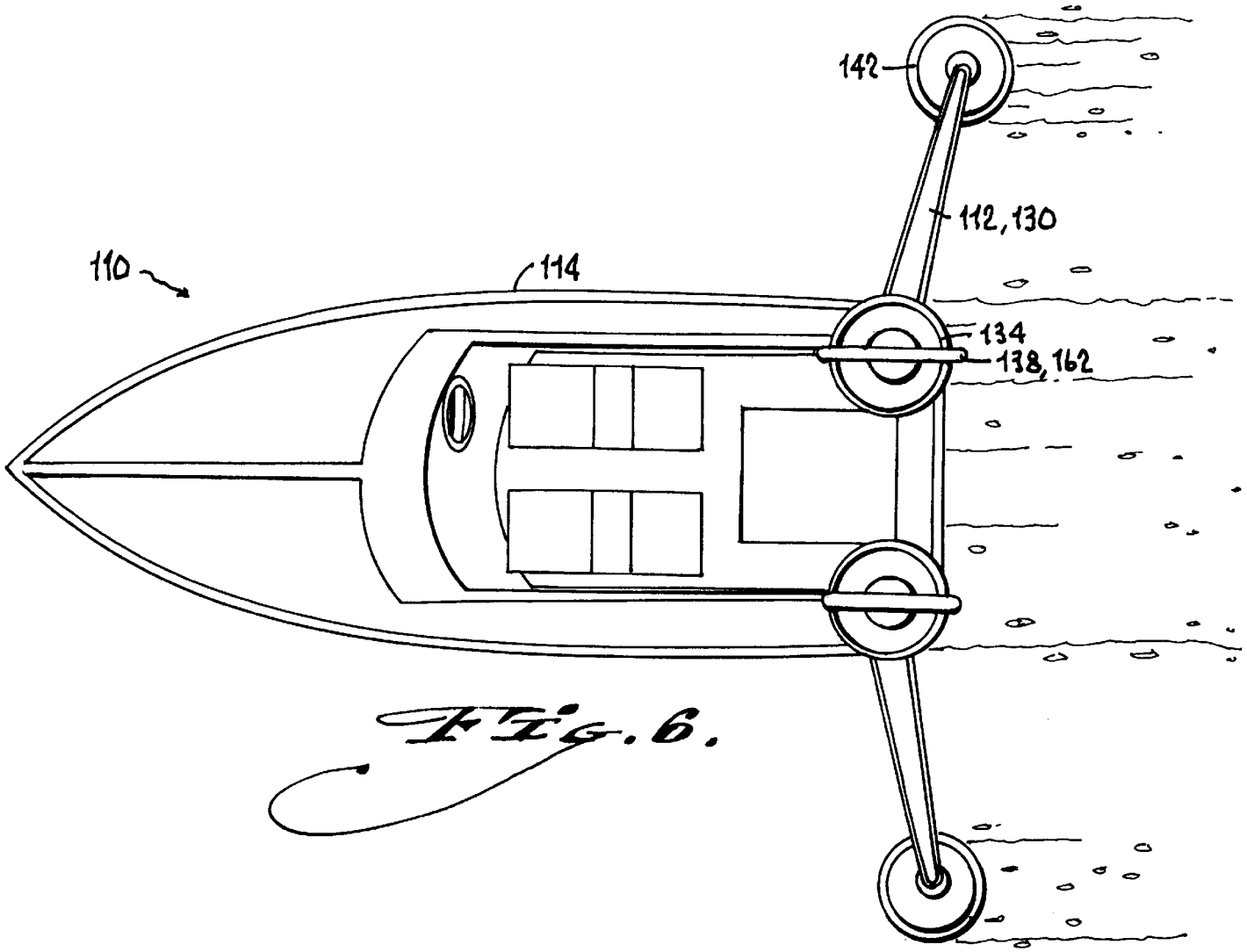
FIG. 6 is a plan view of an alternate embodiment of a boat with adjustable outriggers accordance with the invention.

FIG. 6 shows an alternate embodiment of a boat 110 having outriggers 112 in accordance with the invention. The outriggers 112 include spars 130 that have turntable bases 134, and from the turntable bases 134 the spars 130 extend to pod-shaped capsizing-resistance members 142. The turntable bases 134 allow adjustment of the position of the capsizing-resistance members 142 through various positions clockwise and counterclockwise including straight outboard and straight rearward, and so on.

Figure 7:
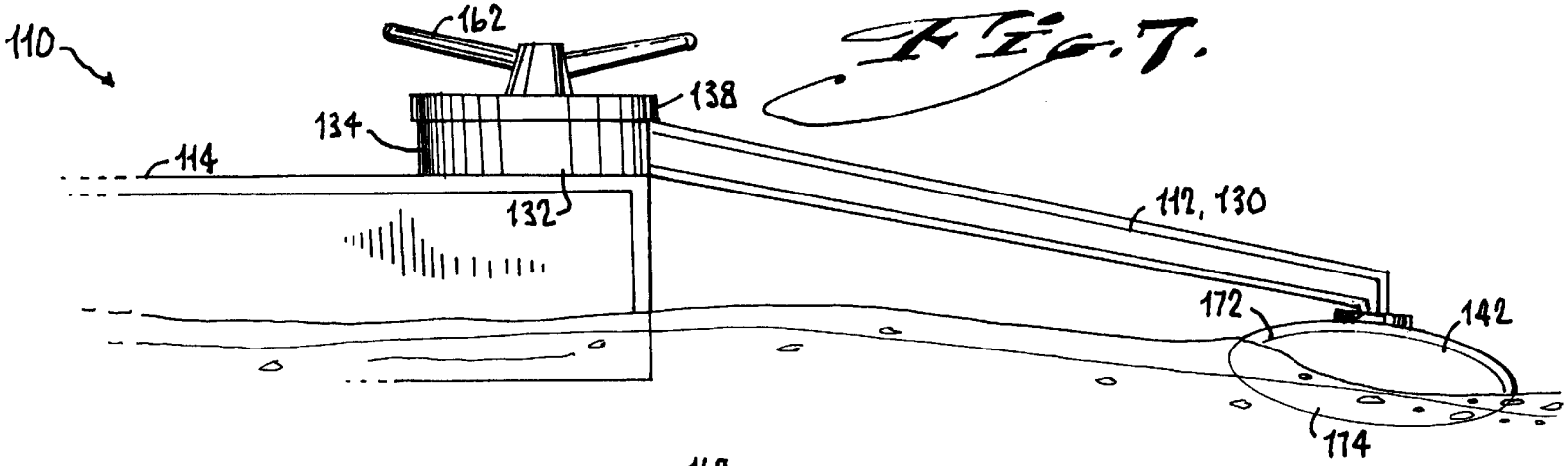
FIG. 7 is an enlarged scale side elevational view thereof, with forward portions broken away.
Figure 8:
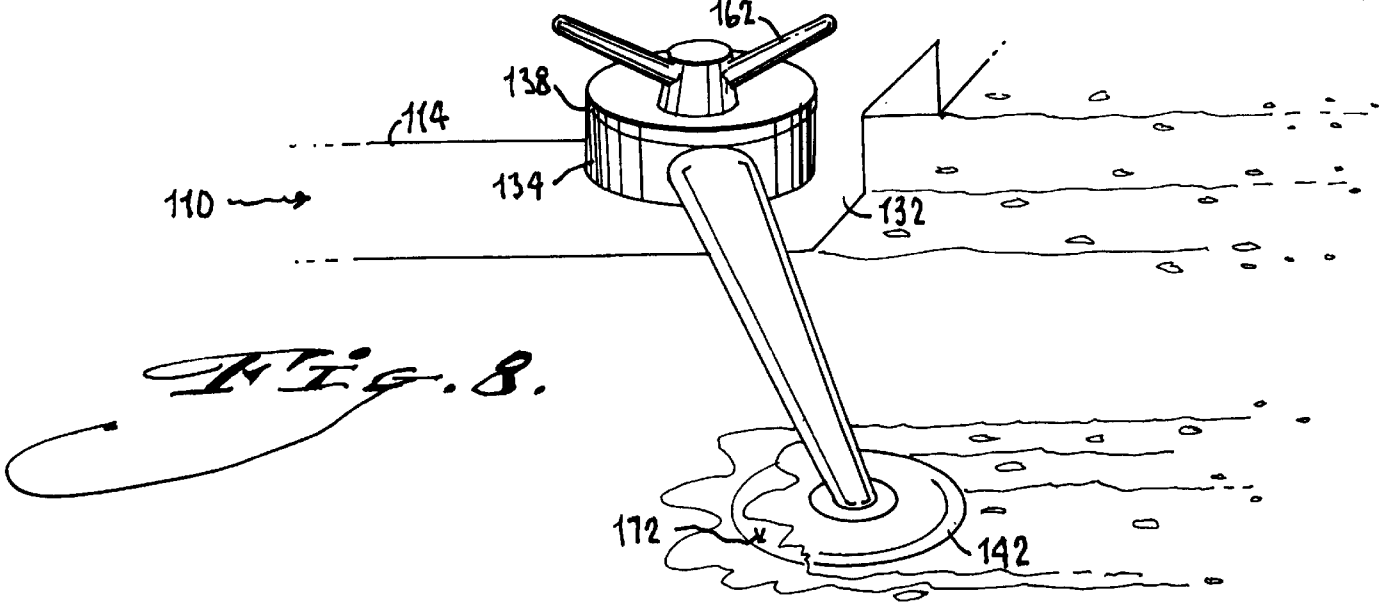
FIG. 8 is a perspective view of FIG. 7.

FIGS. 7 and 8 show that the turntable bases 124 are clamped between a rear corner 132 of the main hull 114 and a locking mechanism 138. The FIGS. 6 through 8 locking mechanism 138 includes a twistable bolt 162 having a cleat-shaped head which not only provides a handhold for tightening and loosening the clamping arrangement 138 but also can double as a cleat for docking or mooring purposes and the like. The advantages of the twistable bolt (or nut) 162 arrangement include that it is relatively simple in construction and economical, and that it allows infinite angular adjustment between the clockwise and counterclockwise extremes of the clamping arrangement 138.

FIGS. 7 and 8 also show further details of the capsizing-resistance pods 142. The pods 142 are pivotably carried at the ends of the outriggers 112 and thus can spin in use. The pods 142 are diminutive relative to the size of the main hull 114, and accordingly displace a substantially small fractional amount of water relative to what the main hull displaces.

In the drawings, the pods 142 are shown skimming the surface of the water, but they are shown that way merely for convenience in this description. It is not necessary for the efficacy of the pods 142 that they skim only. As shown by FIG. 7, each pod 142 has an elevational profile such that it is given an asymmetric foil shape. In accordance with standard airfoil nomenclature, the pod 142 has upper and lower surfaces 172 and 174, and the imaginary surface which lies halfway between the upper and lower surfaces is the "camber" surface (not indicated). For the pods 142, the camber surface is inverted-bowl shaped. Accordingly, the lower surface 174 is the lift surface and the upper surface is the low-pressure or suction surface.

As shown in FIGS. 6 through 8, the pods 142 are skimming on the water surface. As they skim, the pods 142 plane and provide a generally upward, capsizingresistance force to the outriggers 112 through a center of action, which corresponds approximately to the center of geometry of the pod 142. If the pods 142 are submerged, they are still effective for providing a generally upward, capsizing-resistance force by virtue of "flying" through the water, or else by means of what is termed in this description as "hydrodynamic lift." Planing or hydrodynamic lift aside, the pods 142 provide the generally upward, capsizing-resistance force about through their center of geometry generally whenever they are in contact with the water and under forward velocity. The foregoing is an inventive aspect of what is presently disclosed because prior-art outrigger pontoons develop a capsizing-resistance force substantially through buoyance forces alone. In accordance with the invention, the floats 42 depicted in FIGS. 1 through 3 develop a capsizing-resistance force through a combination of buoyancy forces and planing forces. The capsizing-resistance pods 142 either plane on or fly through the water. Accordingly, they develop a capsizing-resistance force by means of planing or hydrodynamic lift, respectively. In view of the foregoing, a relatively diminutive capsizing-resistance formation 42 or 142 can develop a moderate capsizing-resistance force despite being so small. The moderate capsizing-resistance force can be amplified into a meaningful capsizing-resistance moment if the outrigger is sufficiently long.

Figure 9:
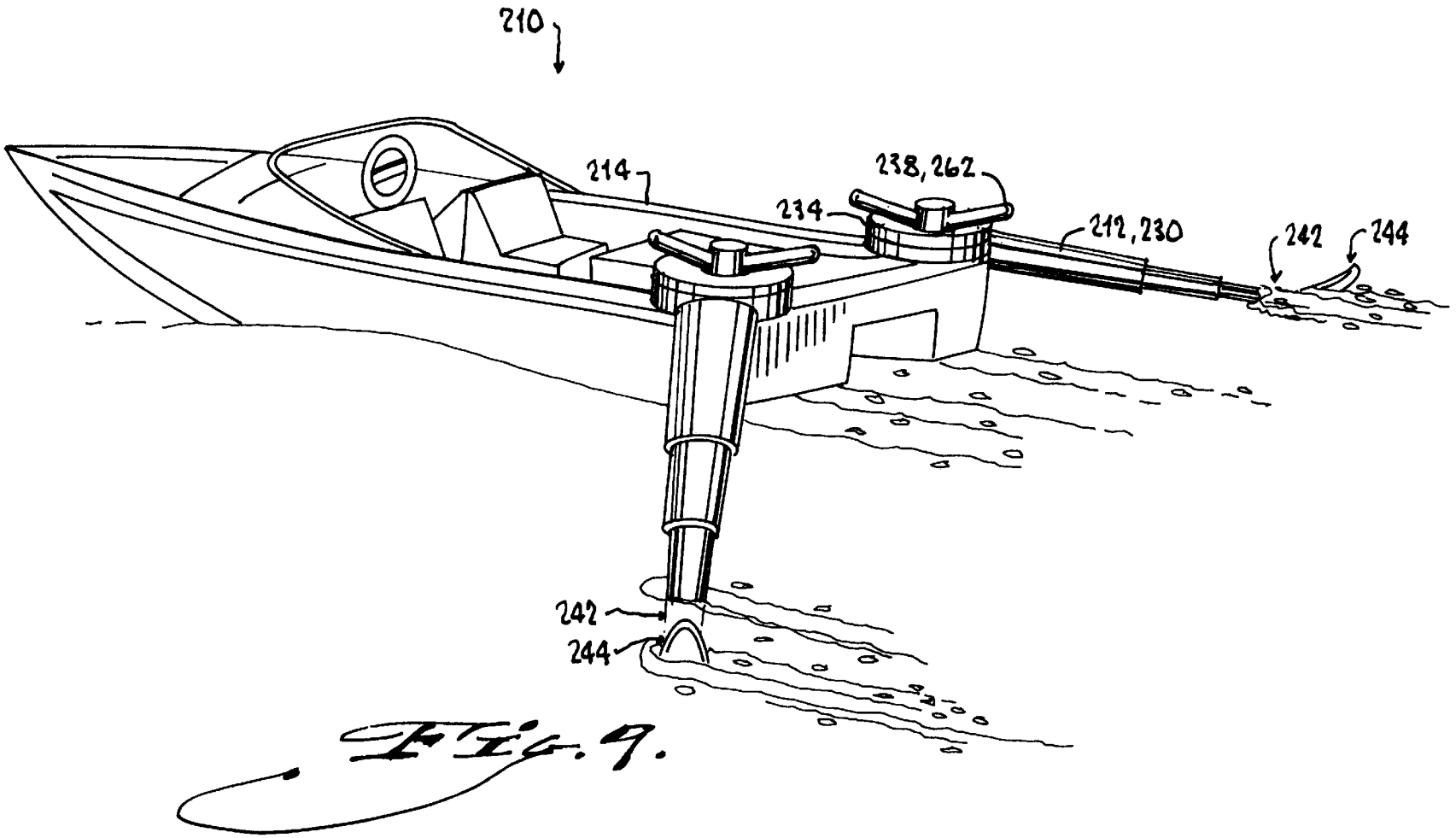
FIG. 9 is a perspective view of an additional embodiment of a boat with adjustable triggers in accordance with the invention.

FIG. 9 shows an additional embodiment of a boat 210 having outriggers 212 in accordance with the invention. The outriggers have comparable turntable bases 234 as shown by the FIGS. 6 through 8 embodiment, as well as comparable clamping arrangements 238 having bolts 262 formed with a cleat-shaped heads.

The outrigger spars 230 comprise telescopic sleeves that allow extension and retraction between extreme extended positions (e.g., as shown) and extreme foreshortened positions (not shown) for adjustability as desired. The outrigger spars 230 extend from their bases 234 to distal curved or upturned end portions 242. The distal end portions 242 are submerged in their middles but they reemerge such that, as shown, their terminal ends 244 elevated slightly above the water surface.

The distal end portions 242 are given an asymmetric foil shape such that their lower surface regions are the lift surfaces and the upper surface regions are their low-pressure or suction surfaces. Accordingly, the distal end portions 242 provide hydrodynamic lift under velocity. Their upturned ends 244 minimize slip losses and increase the efficacy of the foil portions 242. It can be reckoned that the submerged portions 242 and/or 244 of the outriggers 212 displace a substantially small fractional amount of water relative to what the main hull 214 displaces. The capsizing-resistance foils 242 provide hydrodynamic lift through a center of action which approximately corresponds to the center of geometry of the submerged portion. The full amount of hydrodynamic lift developed may perhaps be merely modest even at substantial speeds. However, given the telescopic spars 230, even a modest capsizing-resistance force can be amplified into a meaningful capsizing-resistance moment by virtue of increased extension of the outriggers 212.

The swivelling adjustability of the outriggers 212 allows positioning of the capsizing-resistance portions 242 among various positions of generally outboard and rearward such that the centers of hydrodynamic lift lie spaced substantially straight outboard if desired, or substantially rearward, spaced substantially behind a plane containing the stern of the main hull 214, and so on.

The foregoing arrangements allow a user to choose a given position for the capsizing-resistance portions 242 among the available choices in order to stabilize fore-to-aft pitching as well as side-to-side rolling of the main hull 214. It is an inventive aspect of the capsizing-resistance foil portions 242 that they provide a relatively substantial capsizing-resistance moment when they are actually a relatively diminutive hydrofoil. Partly this is accomplished by virtue of, at increasing speeds, they provide an increasing capsizing-resistance force (i.e., increasing hydrodynamic lift). Also, the capsizing-resistance moment that does result is a factor of the length of the outrigger spars 230. The combined factors of (i) capsizing-resistance force and (ii) the distance between the center of the capsizing-resistance force and main hull 214's centerline, give what the main hull feels in terms of capsizing resistance—namely, a capsizing-resistance moment.

Figure 10:
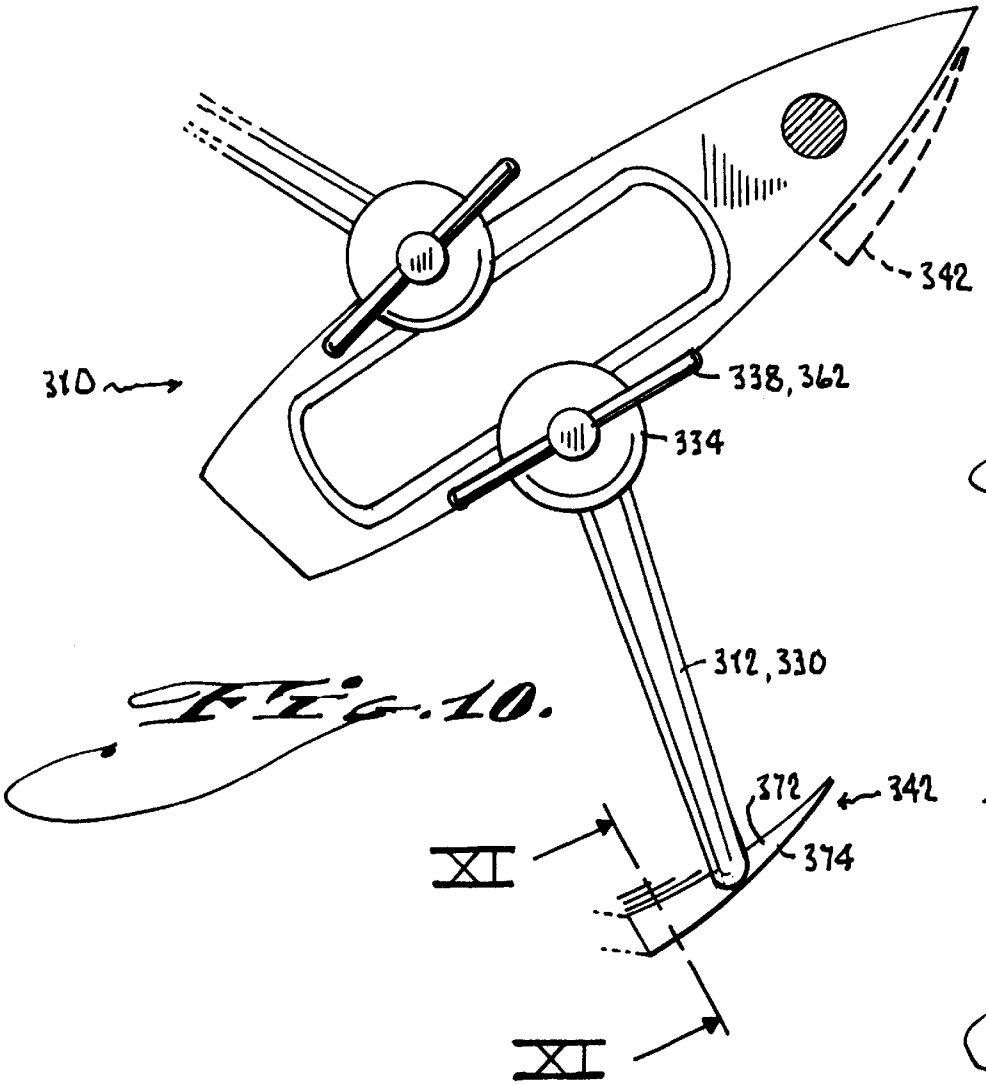
FIG. 10 is a plan view of another embodiment of a boat with adjustable outriggers in accordance with the invention.

FIG. 10 shows another embodiment of a boat 310 having adjustable outriggers 312 in accordance with the invention. The boat hull 314 is representative of sailboats or sail craft generally, rather than the motor boat hulls shown by the previous drawing views. The outriggers 312 include turntable bases 334 that are mounted amidships to the main 314 rather than on the rear corners. The turntable bases 334 are clamped by a comparable clamping arrangement 338 and cleat-shaped bolt 362 as shown by FIGS. 6 through 9.

The outriggers 312 carry capsizing-resistance floats 342. These floats have been shaped and arranged such that when placed straight outboard of the main hull 314, the spray that trails them is thrown the opposite direction from the main hull 314. The spray falling the opposite way insures that the passengers riding in the main hull won't be soaked by use of the outriggers 312 and floats 342. FIG. 10 also shows in dashed lines the location for the floats 342 in a storage or non-use position. The floats 342 are conformal to the hull shape to rest substantially against the forepart of the hull as shown. This allows convenient trailering of the boat 310 and/or maneuverability through tight harbors or passages and the like.

Figure 11:
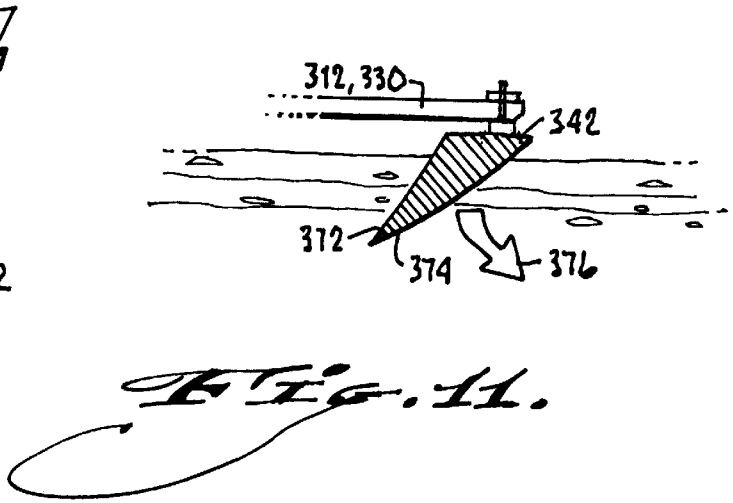
FIG. 11 is an enlarged scale sectional view taken in the direction of arrows XI—XI in FIG. 10.

FIG. 11 shows that the floats 342 are shaped and arranged to throw spray in the outboard direction (i.e., to the right in FIG. 1). The float 342 has proximal and distal side surfaces 372 and 374. The distal side surface 374 is inclined outboard in the upward direction (as shown) in order to develop a planing force normal (i.e., at right angles) to itself (i.e., the distal side surface 374), as indicated by direction arrow 376. As a result much spray will be thrown by the distal side surface 374.

Concurrently, the proximal side surface 372 ought to be shaped so as not to throw spray. It can be inclined as shown, outboard in the upward direction, or it can be arranged to extend nearly vertical (not shown). Given the shape of the two sides 372 and 374, the float 342 as a whole behaves something like a banking slalom water ski—namely, spray is thrown in the direction the ski is banked but not in the direction of the inside of the turn.

Figure 12:
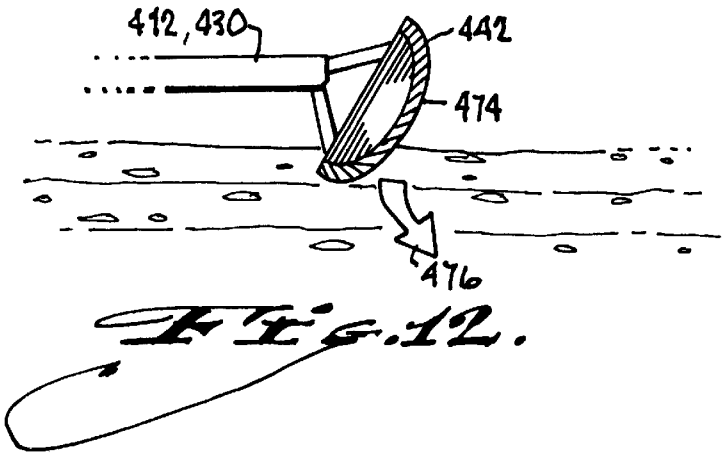
FIG. 12 is a comparable elevational view taken in the direction of arrows XI—XI in FIG. 10.

The objects of the invention achieved by the configuration of floats 342 as shown by FIGS. 10 and 11, can be achieved by floats (or capsizing-resistance formations) given about any other suitable shape for the purpose, including the configuration for capsizing-resistance formation 442 shown in FIG. 12.

The capsizing-resistance formation 442 is attached to the end of the spar 430 of the outrigger 412 as can be reckoned with reference to the previous drawing views. The capsizing-resistance formation 442 has the shape a spherical cap, although it might more-commonly be reckoned as a disk. The capsizing-resistance disk 442 has a planing surface 474 which develops a normal planing force in the direction or reference arrow 476. As comparable to FIG. 11, the disk 442 throws much spray in the direction of planing surface 474 as it moves forwardly through the water (the "forward" direction being straight into the depth of the view), but no spray or nearly none in the opposite direction. Unlike the FIGS. 10 and 11 float, the capsizing-resistance formation or disk 442 is not especially buoyant. All its capsizing-resistance force is developed by planing, not buoyancy. A person having ordinary skill would recognize that the same useful work provided by the disks 442 shown in FIG. 12, can be gotten from any of an indefinite number of other shapes and configurations.

III

Figure 13:
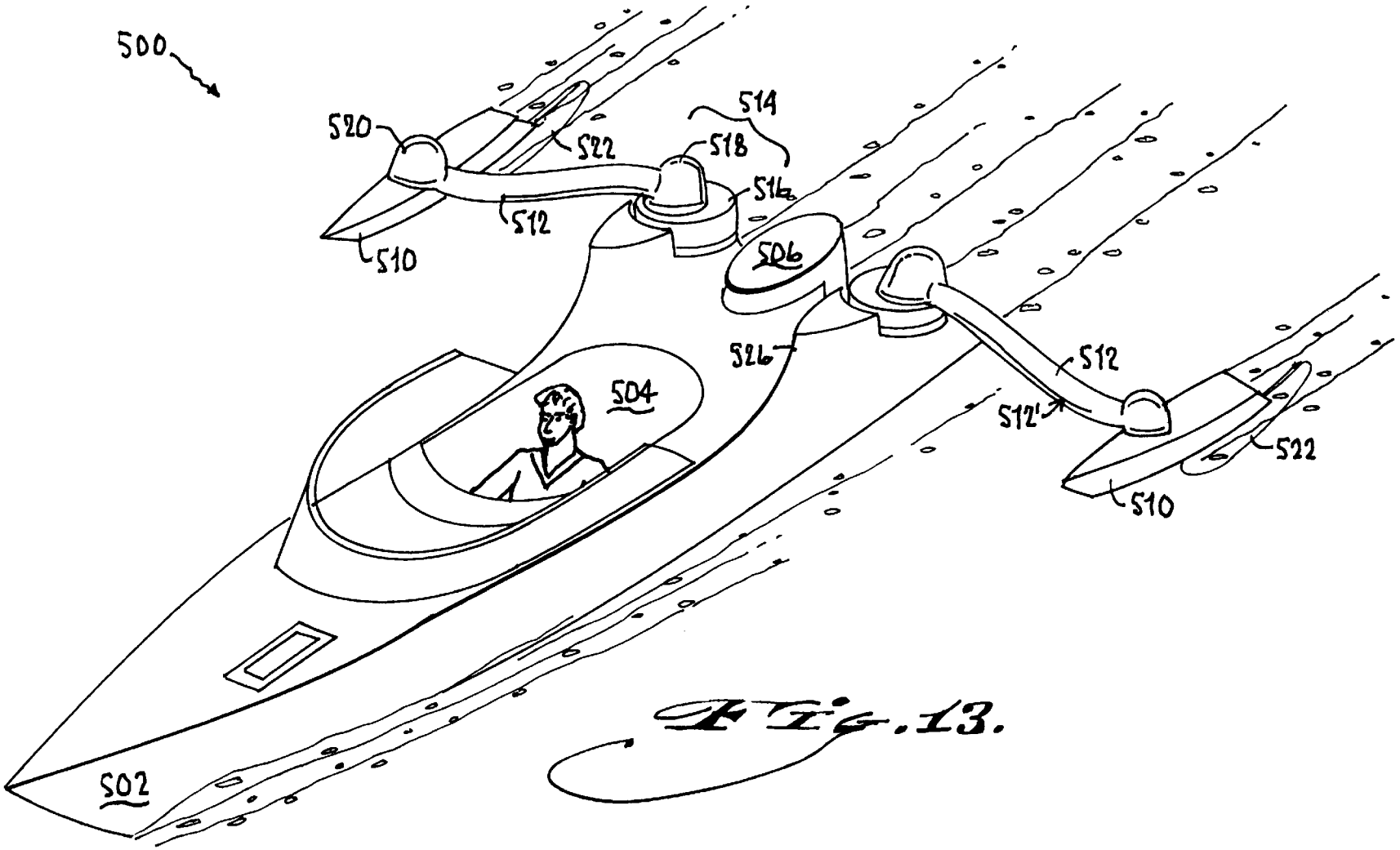
FIG. 13 is a perspective view of a further embodiment of a boat with outriggers in accordance with the invention.

FIG. 13 is a perspective view of a further embodiment of a boat with outriggers in accordance with the invention. The boat 500 has a main hull 502, an operator/passenger compartment 504, an motor 506, and a pair of outrigged stabilizing entities 510 carried at the ends of a pair of spars 512. What is visible as the spars 512 in FIG. 13 is their streamlined casings 512'.

The spars 512 are mounted to the main hull 502 by means of a "shoulder" joint 514 which comprises both a turret mechanism 516 and an elevator mechanism 518 (again, both are substantially hidden by the casing 512'). The spars project away from their shoulder joints 514 to spaced away "wrist" joints 520. The wrist joints 520 allow the stabilizing entities 510 to swivel independently—eg., substantially "freely." The stabilizing entities include rudders 522 (other times termed "tail fins") to assist the appropriate tracking of the stabilizing entities 510 under forward travel, as well as to swing the stabilizing entities 510 about forward and reverse as the main hull 502 changes travel direction between forward and reverse, and vice versa. Other advantages of the independent swivelling of the stabilizing entities 510 will be described further below. Each shoulder joint 514 includes a wind-breaking fairing 526 to reduce wind drag.

Figures 14, 15:
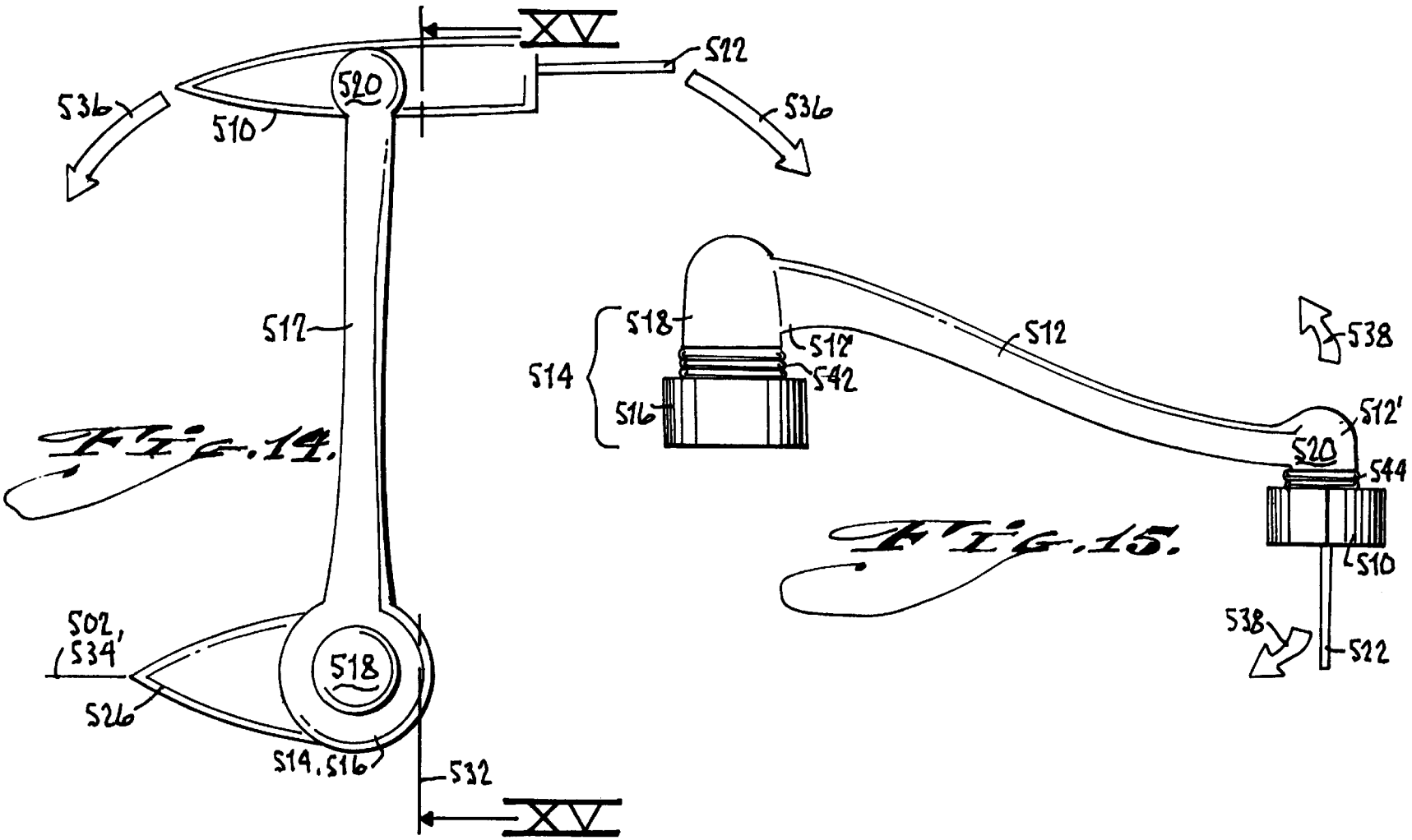
FIG. 14 is an enlarged top plan view of the starboard outrigger arrangement thereof, with forward portions broken away.
FIG. 15 is an elevational view taken in the direction of arrows XV—XV in FIG. 14.

FIGS. 14 and 15 provide respectively a top plan view and a rear elevational view of the starboard outrigger arrangement 510, 512, 514 of FIG. 13. FIG. 15, more particularly, is taken in the direction of arrows XV—XV of FIG. 14.

FIG. 14 shows only as much of the main hull 502 as includes portions of its stern beam or "transom" 532 and another short portion of its starboard beam 534. The fairing 526 for the turret 516 can be seen to have a prow-like leading edge to divert wind around the turret 516. The turret 516 is provided with a drive system which will be more particularly described in connection with FIGS. 16 and 17, that sweeps the spar 512 through horizontal arcs 536. That way, the stabilizing entity 510 can be shifted from the position of almost directly to the side as shown, to positions relatively forward and/or rearward of the plane containing the transom 532 (not shown in this view). FIG. 15 shows that the elevator mechanism 518 (it actually being substantially hidden from view under a streamlined dome casing) operates to sweep the spar 512 through vertical arcs 538. The combined articulations of the shoulder joint 514 (eg., 516 and 518) provide multiple advantages for a speed boat rigged with outrigger-type stabilizing entities 510, as will be described more particularly below.

In FIG. 15, the turret 516 is spaced from the casing 512' or the spar 512 by a gap which is covered by a pleated neoprene sleeve 542. The pleated neoprene sleeve 542 allows the spar 512 to rise or fall along the vertical arcs 538 all while substantially providing a water-proof barrier for the mechanisms inside. A comparable pleated neoprene sleeve 544 is incorporated between the stabilizing entity 510 and the casing 512' at the wrist joint 520 portion of the spar 512. This other pleated neoprene sleeve 544 likewise provides a substantial water-proof seal between the spar 512 and stabilizing entity 510 which not only accommodates the swivelling of the stabilizing entity 510, but also accommodates changes in "attitude" of the stabilizing entity 510 relative to the wrist joint. The attitudinal changes of the stabilizing entity preferably include fore-to-aft changes in pitch as well as side-to-side changes in tilt or list, as will be more particularly described below in connection with FIGS. 19 through 22 below.

Figure 16:
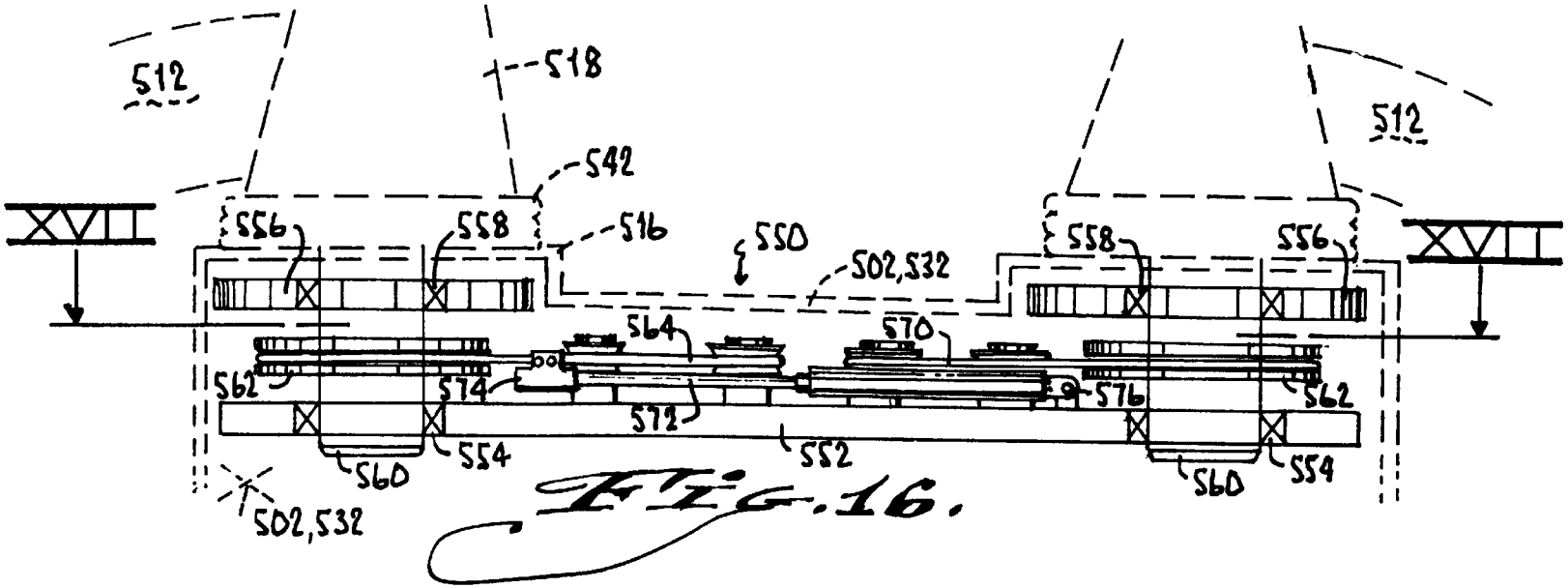
FIG. 16 is an enlarged scale elevational view taken in the direction of viewing the transom of the boat in FIG. 13 from the rear, with portions broken away and other portions shown in dashed lines, and showing the mounting structure for the twin turrets that cooperatively mounts the outrigger spars to the main hull as well as sweeps the outrigger spars in horizontal planes.
Figure 17:
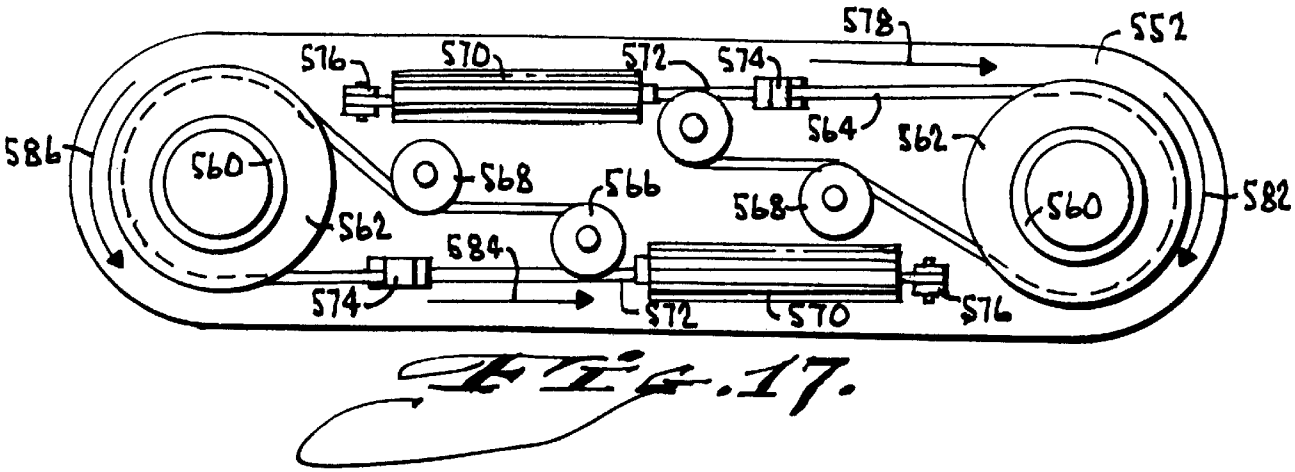
FIG. 17 is a top plan view of FIG. 16.

FIGS. 16 and 17 show the drive system(s) 550 associated with the turrets 516 that sweep the spars 510 through horizontal arcs (eg., indicated as 536 in FIG. 14). FIG. 16 is an elevational view taken in the direction of viewing the transom 532 of the main hull 502 from the rear. FIG. 17 is a top plan view of FIG. 16.

The drive system comprises a base deck 552 that extends transverse across the main hull 502 from side to side right against the transom 532. The base deck 552 has opposite ends formed with openings for mounting a lower set of bearings 554. The base deck 552 also props up a pair of opposite upper decks 556 above the lower set of bearings 554, which upper decks 556 (the propping legs therefor are not shown) support a set of upper bearings 558. These sets of upper and lower bearings 554 and 558 support a pair of opposite spar-masts 560 on top of which ultimately is carried the spars 512. The bearings 554 and 558 naturally enable the rotation of the spar-masts 560, and rotating the spar-masts 560 correspondingly sweeps the spars 512 through horizontal arcs (eg., indicated as 536 in FIG. 14).

FIG. 17 shows that the spar-masts 560 are substantially hollow pipes. With general reference to both FIGS. 16 and 17, there is fixed to each spar-mast 560—at about its middle between its coupling in the upper and lower bearings 554 and 556—a sprocket wheel 562. Each sprocket wheel 562 is turned by a chain 564 that extends in a loop around an idler sprocket 566 and against a tensioner sprocket 568. Each chain 564 is looped in such a way that it defines its longest run between the mast-sprocket 562 and idler sprocket 566. The source of drive is provided by a pair of double-acting hydraulic cylinders 570 that have piston rods 572 terminating in fixtures 574 pinned between a pair of links in the chain 564 in its longest run (ie., the span between the mast-sprocket 562 and idler sprocket 566). The hydraulic cylinders 570 have yoke-style back ends 576 that are pinned stationary to the base deck 552 by suitable brackets attached to the base deck.

FIG. 17 shows that extension of the starboard-drive cylinder 570's rod 574 in the direction of extension arrow 578 causes the starboard spar-mast 560 to turn in the clockwise direction indicated by 582. On the other side, retraction of the port-drive cylinder 570's rod 574 in the direction of retraction arrow 584 causes the port-side spar-mast 560 to turn in the counter-clockwise direction indicated by 586. Hence, by concurrent and equal extension 578 and retraction 584 of the starboard- and port-side cylinders 570 respectively, produces equal sweeping of the starboard- and port-side spar-masts 560 in the corresponding clockwise 582 and counter-clockwise 586 directions. This cooperatively produces in the starboard and port spars a concurrent and equal amount of aft-ward sweeping in the spars 512. As previously mentioned, the cylinders 570 are double-acting and thus the forward sweeping of the spars 512 is caused by reversing the directions of extension and retraction in the complementary pair of cylinders 570.

An inventive feature of the independent drive cylinders 570 is that the spars 512 can be positioned in unequal angles if that is desired instead. The drive cylinders 570 are provided with pressurized hydraulic oil by a hydraulic pump system which is conventional (except as discussed in connection with FIG. 27 below) and otherwise not shown.

Figure 18:
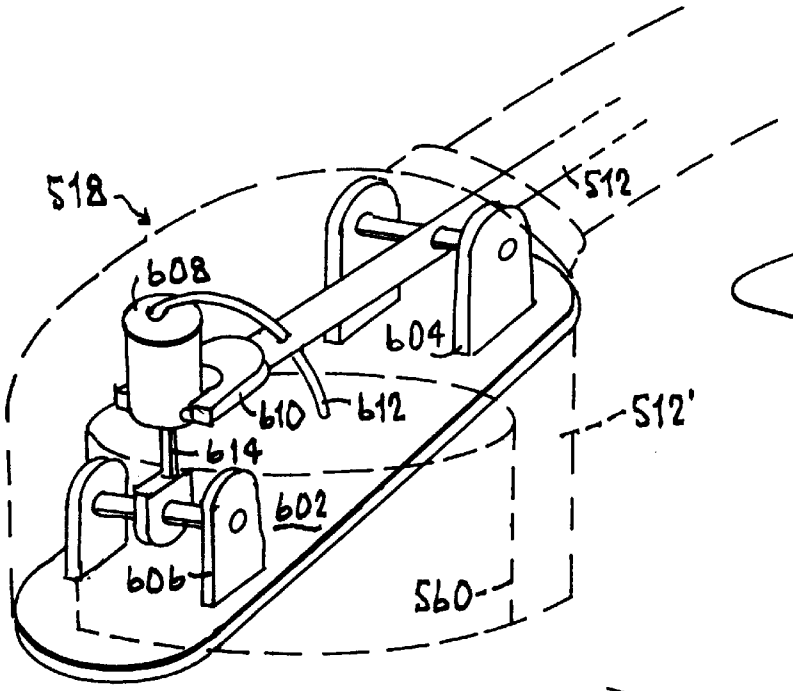
FIG. 18 is an enlarged scale perspective view of the turret of the starboard outrigger arrangement of FIG. 14, with portions broken away and other portions shown in broken lines, and showing the spar-elevating mechanism which sweeps the outrigger spars in vertical planes.

FIG. 18 more particularly shows the spar-elevating mechanism 518 (ie., for the starboard side, the port side being a mirror opposite) which sweeps the outrigger spar 512 in vertical planes (eg., which are indicated as 538 in FIG. 15). The spar-elevating mechanism 518 has been generally hidden from view in the previous views by the casing 12' for the spar 512. In FIG. 18, the top of the spar-mast 560 is attached to a T-head 602. The T-head 602 is plate which can be simply welded or otherwise attached to the spar-mast 560. The T-head 602 carries an outboard pin frame 604 and an opposite inboard pin frame 606. The spar 512 has yoke-style end 610 which is pinned to lower end of a double-acting hydraulic cylinder 608. The cylinder 608 has a piston rod 614 extending out is lower end which is pinned to the inboard pine frame 606 as shown. The spar 512 extends away from its yoke-style end 610 and through the outboard pin frame 604 where it (the spar 512) is engaged in a pin connection therewith as shown. The cylinder 608 is supplied power by hydraulic line(s) 612, which thread(s) through a hole in the T-head and through the spar-mast 560 for connection to the main, onboard hydraulic pump system (again, which generally is conventional except as shown by FIG. 27, and is otherwise not shown).

Given the foregoing, raising and lowering of the spar 512 is accomplished by correspondingly retracting or extending the piston rod 614 by means of the hydraulic cylinder 610. That is, the hydraulic cylinder is driven relatively up and down, and this correspondingly rocks the spar 512 about the outboard pin frame 604. Altogether these features allow an operator of the boat (eg., 500 in FIG. 1) to sweep the spars 512 through a limited range of vertical arcs, which are generally indicated as 538 in FIG. 15.

Figure 27:
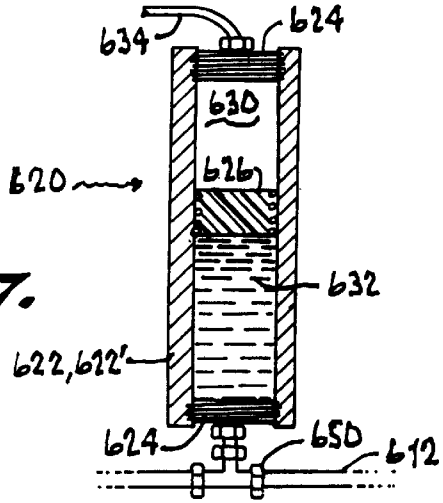
FIG. 27 is a hydraulic schematic of an air-oil accumulator incorporated in the hydraulic controls in accordance with the invention, to allow varying the rigidity of the spar controls be en extremes of stiff and soggy.

To look ahead to FIG. 27, it shows one representative hydraulic shock arrestor 620 which is connected by a Tee fitting 650 in the hydraulic lines (eg., 612 as shown by FIG. 18) to provide varying 'sogginess" in the hydraulic cylinders. Without the shock arrestor 620, an example hydraulic cylinder (say, cylinder 608 as shown by FIG. 18) would hold tight the position of the component it drives or lifts and so on (in the case of FIG. 18, the driven component is the spar 512 as rocked relatively up and down). The shock arrestor 620 allows the operator to control the relative degree of "sogginess" in the set position of the spar 512, so as to allow bounce for shock absorbing purposes. Or. conversely, the shock arrestor 620 allows the operator to control the relative degree of "stiffness" in the set position of the spar 512, so as to effectively remove any bounce in the set position in the spar 512.

The shock arrestor 620 works on a comparable principle as does a water-hammer arrestor. It has a pocket of compressible gas. More particularly, the shock arrestor comprises an accumulator 622 having a cylindrical body 622' with internal threads in both ends. Threaded caps 624 are screwed into the ends. Inserted inside the accumulator 622 is a piston 626 which with multiple sets of O-rings provides an effective seal between an upper air chamber 630 and a lower oil chamber 632. Air or any suitable compressible gas can be charged into or sucked out of the air chamber 630 by means of an air line 634.

In use, the gas inside the air chamber 630 is maintained at any suitable or moderate pressure to give the desired "bounce" to the spar 512. The piston 626 tends to find an equilibrium position that eliminates any pressure differential across it. Maintaining a moderately high pressure in the air chamber 630 produces a relatively "tighter" suspension of the spar 512. Any applied force transmitted to the spar 512 vis-a-vis the stabilizing entity 510 (see, eg., FIGS. 13 through 15) is likely to be damped quickly with small amplitude oscillations.

On the other hand, maintaining a moderately low pressure in the air chamber 630 produces a relatively "soggier" suspension for the spar 512. Any applied force transmitted to the spar 512 vis-a-vis the stabilizing entity 510 is likely to be damped more slowly and by relatively larger amplitude oscillations. Both scenarios assume that the air pressure is neither so low or so high that the piston 62 is allows to bottom- or top-out respectively against the end caps 624. When that happens, either way, the suspension-damping effects of the arrestor 620 are wholly negated.

The preferred suspension for any given use of the boat 500 varies much under the circumstances of the use. An operator finds the proper degree of suspension damping for any given set of conditions by adjusting the pressure in the chamber 630 through routine trial and error until he or she gets the desired effects, whether in the spar-elevating mechanism(s) 518 or the drive system(s) 550, and so on.

FIGS. 19 through 22 deal with a complicated refinement concerning the control of the "attitudinal" positioning of the stabilizing entity 510 relative its associated wrist joint 520. However, preliminary reference to FIG. 19 alone shows one major aspect of the mounting arrangement for the stabilizing entity (not shown, but indicated as 510 in other views. More particularly, the stabilizing entity is suspended from the wrist joint by means of a spindle 640. In one proof-of-concept prototype built by the inventor hereof, the spindle 640 was a simple section of pipe. The stabilizing entity 510 was fashioned out of a wood block. The bottom of the spindle 640 was threaded and screwed into a pipe flange (this is not shown in the drawings). The pipe flange was bolted to the top of the wood-block stabilizing entity by a circuit of lag bolts (again, none of this is shown by the drawings, this merely being a description of one of this inventor's proof-of-concept prototypes).

Figure 19:
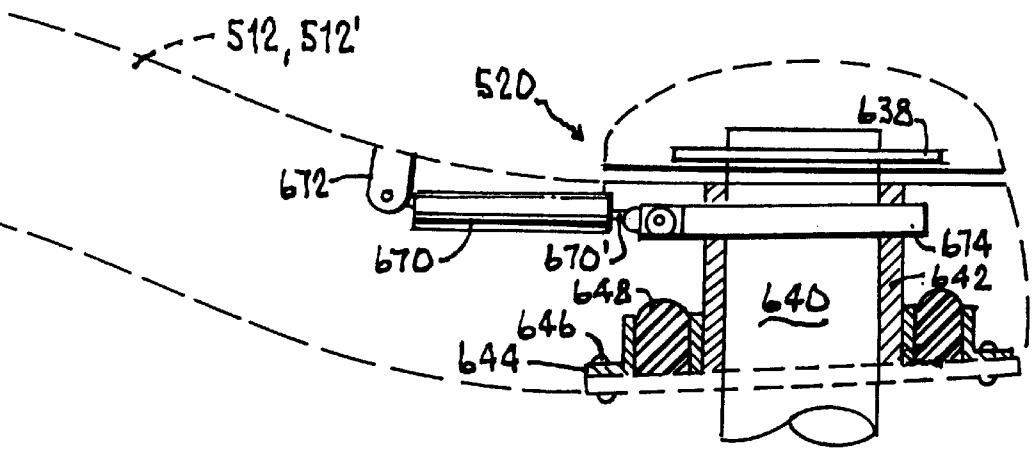
FIG. 19 is an enlarged scale elevational view of the terminal end of the starboard outrigger of FIG. 14, as taken in the direction of arrow XV—XV, with portions broken away and other portions shown in broken lines, and partly showing the stabilizing-entity attitude-control mechanisms for changing the attitude of the stabilizing entity relative to the end of the spar.
Figure 20:
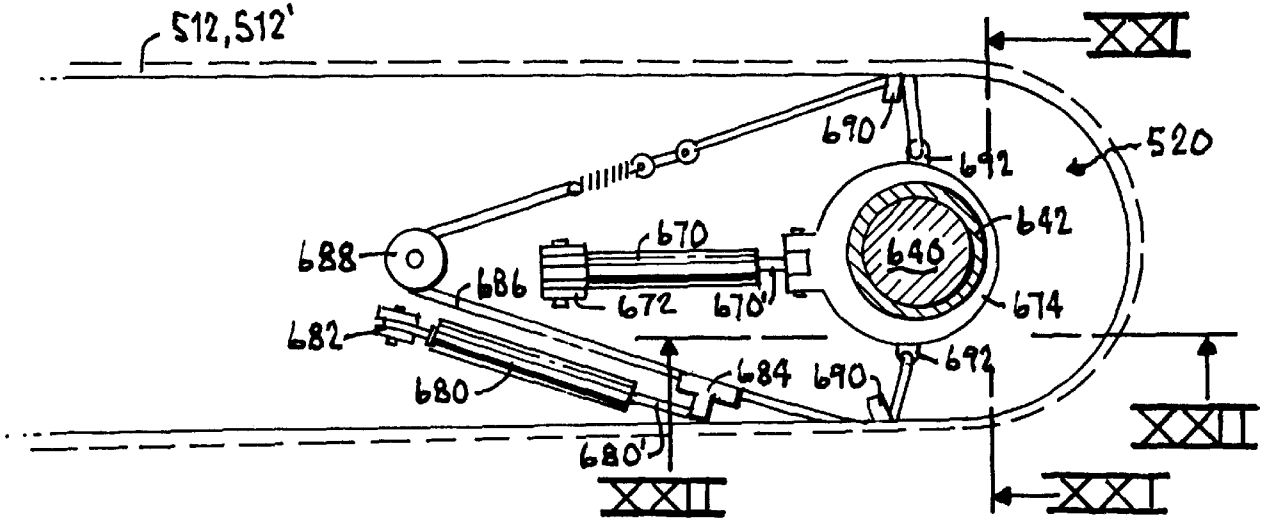
FIG. 20 is a top plan view of FIG. 19.

More pertinent to the present how the spindle 640 is coupled to wrist joint 520, as shown by FIG. 19. The spindle 640 inserts through a guide sleeve 642 that allows the spindle 640 to swivel in full revolutions, indefinitely. The spindle 640 is locked from withdrawal out of the guide sleeve 642 by means of a retaining washer 638. There is some frictional drag between the inside of the guide sleeve 642 and outside of the spindle 640, but it is low. Whereas there must be some threshold impulse applied to the stabilizing entity 510 to cause the spindle 640 to break loose from the grip on it by the guide sleeve 642 and hence swivel, the threshold force is low. Actual trials show that the stabilizing entity 510 is highly mobile in terms of how freely it swivels in this kind of connection.

The guide sleeve 642 is attached to the spar 512 merely by means of a pipe flange 644 affixed to its bottom end. The flange 644 is fastened by bolts 646 to the periphery of a suitable opening for it in the casing 512' of the spar 512. This pipe flange 644, more particularly, incorporates a synthetic rubber ring 648 as is typical of vibration-absorbing motor mounts. In a relaxed state, the synthetic rubber ring 648 holds the guide sleeve at right angles to the flange 644 (as shown by FIG. 19). However, this synthetic rubber ring 648 can be stressed and allow a minor degree of deviating for the guide sleeve 642. Whereas the guide sleeve 642 cannot spin, its top end can deviate to a limited extend within an imaginary inverted cone which flares out by a small angle.

Again, for the present, a major aspect of the spindle 640 from the stabilizing entity a 510 is suspended is, that the spindle 640 (and hence the stabilizing entity 510) is generally free to swivel in complete turns if an impulse so causes it to do so.

The foregoing description of the form of the invention to date as shown by FIGS. 13 through 19 and 27 (as well as the earlier FIGS. 1 through 12) affords the following matters to be discussed.

It has been discovered that major aspects of the invention especially provide benefits for boats having main hulls which are of the planing-type. However, this does not negate that various aspects also provide useful enhancements for semi-displacement hulls. It is also interesting that aspects of the invention are highly advantageous for displacement hulls, including what will be shown in connection with FIGS. 28*a* and 28*b*:—eg., a tug- or push-boat.

The boat can be produced with spars in multiple ways in accordance with the invention, and not in just one full-featured way which incorporates all of the articulations lately shown by FIGS. 13 through 19. That is, the boat can be produced with the spars fixed to just one set position, or else produced with limitedly adjustable spars having that extend out to just one practical use position but otherwise retract to a storage position. Otherwise the spars can be produced to articulate at the main hull as the "shoulder" joint 514 shown previously. For example, such a "shoulder" joint 514 might be produced so that only the angle of the horizontal sweep is variable, or that only the angle of the vertical sweep is variable, or else so that both the angle of horizontal and vertical sweep are variable.

The stabilizing entities can be variously produced as floats, ie., especially buoyant. Producing the stabilizing entities to be highly buoyant is advantageous for applications such as to stabilize the main hull at dead stop in waves, as for example fishing boats or crab and lobster tenders and so on. Alternatively, the float can be produced with no real measurable buoyancy such the all the capsizing-resistant lift that they develop occurs when they have climbed onto their plane. That is, the lift that stabilizing entities on is not measurable until they plane. Needless to say, the stabilizing entities must be configured suitable for planing, as several of the foregoing embodiments thereof show. Such planing-style stabilizing entities may float, but what's significant is that they have no more useful buoyancy than perhaps to float themselves only at a stop. Also disclosed in the previous figures have been foils for incorporation as the stabilizing entities, in that the submerged portions thereof provide lift as underwater wings.

It has been discovered that it is highly beneficial to connect the stabilizing entities to the spars such that the stabilizing entities are allowed generally free and unrestrained swivelling. Experience has shown that such "free" swivelling improves the maneuverability of the boat as a whole because it lessens the drag or pull from the stabilizing entities. Each stabilizing entity is independent to fight its own struggle with the local wave conditions it faces and is not enslaved in this respect to the main hull. Put differently, the "free" swivelling allows each stabilizing entity to change its local heading to an angle that offers the least resistance. This can be likened to a land vehicle such as a riding-style tricycle lawnmower:—the rear wheels are casters to offer less resistance. Again, "free" is a relative concept. There usually is some frictional resistance involved. Casters on the other hand swivel very loose because of bearing mountings. The stabilizing could be likewise mounted with bearings. However, given the corrosive environment of water, simpler mountings which withstand corrosive attack have been preferred by the inventor. Whereas these simpler mountings do have some inherent drag built-in, observation of the swivelling of the stabilizing entities under actual trials appears to show that the swivelling is very loose.

In cases involving of planing-style stabilizing entities, allowing free swivelling of the stabilizing entities is more likely to find that the stabilizing entities ride on their plane and are less likely to drop off. Probably, when a planing-type stabilizing entity is pitched or pushed below the surface, it is more likely to find that it can more easily climb out of the hole and back onto its plane because it is free to swivel and fish-tail back and forth while doing so.

Also, in cases involving planing-style stabilizing entities which are stationary at dead stop, the swivelling is still advantageous when starting forward travel because the swivelling it probably allows them to more easily climb over their bow wave and onto their plane from stop to go.

Moreover, free-swivelling stabilizing entities are less vulnerable to damage when they strike an object. Swivelling allows maneuvering the main hull in reverse more practicable. In cases where the plaining-style stabilizing entities are not disks (as shown previously), then they can be equipped with rudders (perhaps disks can be given rudders too). That way, when a stabilizing entity bounces up airborne, the rudder catches wind or the water surface first and thus turns the stabilizing entity in the proper heading before landing. It is believed that this prevents the stabilizing entity from landing broadside and potentially tear off at the spar. Furthermore, when the main hull executes a turn, swivelling allows the stabilizing entities to sweep out their own arc independent of the main hull.

FIG. 27 shows how to both use hydraulics in changing the position of the spars as well as achieve non-rigid suspension of the stabilizing entities. That is, hydraulics are employed to change the angle of the horizontal sweep, as well as the angle of the vertical sweep is variable, as well as change both angles of horizontal and vertical sweep with the spars. In general, though, hydraulic systems would be expected to position the spars firmly in rigidly set position. Again, FIG. 27 shows how to achieve non-rigid suspension of the stabilizing entities from the ends of the spars.

By way of background, the use of the term "suspension" here and some analogies which can be given therefor, are borrowed from the terms more normally encountered when speaking of automobiles. That is, it is considered in this written description that the stabilizing entities are "suspended" from the spars like tires are "suspended" from an automobile frame. In truth it could be reckoned that the auto chassis is propped on the tires but still the conventional way of speaking about the linkage between the tires and the chassis is to call it a "suspension."

One of the objects of providing non-rigid suspension of the stabilizing entities is, naturally enough, to provide shock absorption, as for cushioning the ride felt by the passengers. Also, as the main hull heels port or starboard, a non-rigid suspension produces in the main hull a slower response or roll-back, which is the product of the counteracting up-righting moment provided by the stabilizing entity. Put another way, the main hull tends to roll back to upright more gently.

Moreover, a non-rigid suspension is less likely to find the stabilizing entity plowed under the water surface by the heeling of the main hull. But if the stabilizing entity should plow the surface, then a non-rigid suspension should let it climb out up to the surface and then climb onto its plane more easily than otherwise. For those reasons and others, it is believed that a non-rigid suspension lessens drag.

Various arrangements which allow for accomplishing a non-rigid suspension can be achieved by flexible spars mounted rigidly to the main hull (eg., FIGS. 1–3), or rigid spars mounted flexibly (eg., FIGS. 13–19 and 27), as well as by hybrid arrangements falling variously therebetween. FIG. 19 also shows how to do this by providing flexion in the connection between the spar and stabilizing entity;—ie., at the wrist joint 520 and incorporating the synthetic rubber ring 648. That way, spindle 640 and the attached stabilizing entity 510 is allowed some degree of rotational circumduction relative to the spar 512.

The feature of the suspension shown by FIG. 27 is the aspect of the shock arrestor 620 allowing adjustable "tightening" or "loosening" of the suspension for the stabilizing entities. This device 620 has the form of an air charged accumulator 622 connected into a Tee 650 (see, ie., FIG. 27) into the hydraulic line 612 for the drive-cylinder 608 of the spar-elevating mechanism 518 (see, ie., FIG. 18). In an alternative form some sort of screw-tightened compression spring can be incorporated.

However it is achieved, the desirability of an adjustable the suspension for the stabilizing entities—such that the suspension can be variably "tightened" or "loosened"—provides many advantages.

Adjusting the suspension can be changed done for sake of adjusting the quality the ride over calm or rough water. For example, tightening the suspension is likely to tighten the ride, and this is probably best limited to instances when riding over calm water. Much like an Indy-style race car has a stiff suspension for a smooth track, tightening the suspension in the boat is preferably a matter which is done for a high-rate of travel over calm water.

In the other direction, loosening the suspension is likely to yield a more soggy ride. Just like a dune buggy has a loose suspension for handling a bump-strewn course, so can the boat's suspension be slackened for handling rough water. This allows an operator to find ra comfortable roll-back or up-righting rate for when the main hull heels over.

To consider another situation, consider when the boat 500 is sitting at a dead stop in the water and the spars 512 are angled aft such that the stabilizing entities 510 are located somewhere substantially rear of the plane of the transom 532 of the main hull 502. For sake of reference, this is shown by FIGS. 23 through 26. In cases when the suspension is be slackened to the point that the spars 512 are free to flop about with little resistance, then loosening the suspension can also be a way of allowing the stationary stopped main hull 502 to climb onto its plane from stop to go. That way, the unresisting spars 512 won't fight the main hull 502 back into its hole as it tries to climb out. Once on the plane the suspension can be adjusted to a setting appropriate for the water conditions and the desired quality of ride.

The foregoing point merits further discussion in connection with FIGS. 23 through 26. Trials have found a problem with the spars 512 angled aft of the transom 532 while the boat 500 sits at dead stop. Typically the angle of the spars 512 is set before the boat 500 is started for forward travel. However, early proof-of-concept prototypes built by the inventor did not (comfortably) allow adjusting the spars 512 once underway. The following problem was discovered.

Figure 24:
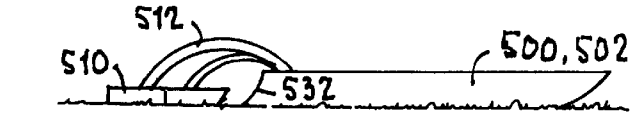

In FIG. 24, the boat 500 has just been throttled to start forward in direction 652. The main hull 502 is a planing-style hull. To get up on its plane, the main hull 502's stern wants to squat down in direction 654 at the same time its bow wants to lift up in direction 656. In fact, the bow might reach up as high as datum 658 and the stern as low as datum 662 before the main hull 502 climbs over its bow wave and onto its plane. However, and this is the problem, as the stern seeks to squat down in direction 654, it also drives rigidly-positioned spars 512 down such that stabilizing entities 510 are depressed down in directions 660. If—and this generally didn't happen—the main hull 502 was to succeed in squatting its stern down to datum 662, then that meant it would have had to submerged the stabilizing entities 510 down in directions 660 to datum 664.

As discovered, the stabilizing entities 510 simply provided too much stern lift. The stern of the main hull 502 could not successfully fight the stern lift provided by the stabilizing entities 510 to squat down in direction 654 sufficiently and climb onto its plane.

Figure 25:
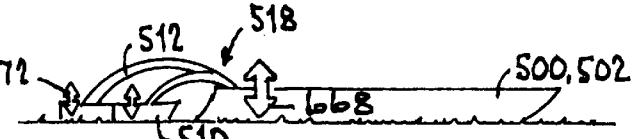
Figure 26:
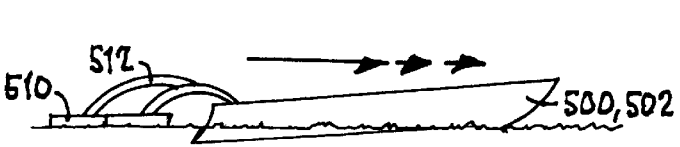

One solution (others will be described more particularly below) has been to provide and adjustable suspension, as shown by FIG. 25. The spar-elevator mechanism 518 has been slackened such that the spars 512 are free to flop up and down in directions 668. The stabilizing entities 510 are free to float on the surface and move up and down relative to the main hull in directions 672. FIG. 26 shows the happy result. The stern is allowed to squat down without being fought back up by stern lift from the stabilizing entities. The bow can rise. The main hull 502 does indeed climb up onto its plane. Again, this is achieved because the spars 512 are floppy, to floppy to transmit the stern lift to the stern provided by the stabilizing entities. Once the main hull 510 is on its plane, the spar-elevating mechanism 518 can be "tightened" as desired to remove the floppiness out the spars 512, and allow the spars 512 once again to transmit benign stabilizing forces.

Another way to combat and solve this problem has been accomplished by providing a mechanism 518 which can simply lift the spars during the time the main hull 502 struggles to climb onto its plane, for the spars 512 to be lowered once the main hull 502 has succeeded onto its plane to a desired use position. Again, this other way comprises varying the angle of vertical sweep (eg., indicated as 538 in FIG. 15) of the spars 512.

Indeed, providing a mechanism (eg., 518) for varying and/or adjusting the angle of vertical sweep in the spars 512 provides multiple other advantages, partly as follows.

That is, allowing a varying the angle of vertical sweep accommodates variations in the load in the main hull. Changes in load in the main hull changes the "load water line" (a term of art in boat design). Generally, the heavier the load the higher the water line relative to the "design water line" (another term of art), and the lower the freeboard. Adjusting the stabilizing entities vertically up allows the operator to raise the stabilizing entities to maintain the same relative elevation of the stabilizing entities, not with respect to the main hull 502, but with respect to the main hull 502's change water line:—ie., its new load water line.

Also, in contrast to the foregoing, varying the angle of vertical sweep allows the operator a measure of control over trimming the main hull on its plane. In cases where the main hull is laden with an especially heavy stern load, adjusting the stabilizing entities vertically down provides a compensating stern lift that allows the operator to trim out the main hull regardless of the stern-heavy load.

Moreover, the provision of an adjustable angle of vertical sweep allows adjustment as when the boat is traveling rapidly over calm water, to virtually lift the stabilizing entities off the water. That the way the main hull 502 behaves much like a mono-hull, except when it rolls slightly, and then the stabilizing entity on that side of the roll can be there to give the main hull a gentle up-righting force.

In cases where the stabilizing entities are buoyant, an adjustable vertical sweep for when the boat is brought to a stop allows the operator to depress the stabilizing entities forcefully into the water and hence maximize the buoyancy-supported stability provided by the stabilizing entities. This is especially advantageous for a small boat such as a working boat or fishing boat (and crab and lobster tenders and so on) to be stabile in rough water while the workers are at work. It is simply plain that the outrigged stabilizing entities provide much useful stability to a stationary or slowly idling boat. As said, a working boat such a fishing boat or crab-pot tender is often used in stop and go cycles. And when stopped, especially in heaving seas, any mono-hull without outrigged stabilizing entities experiences much buffeting or pitching and rolling. The inclusion and deployment of outrigged stabilizing entities in accordance with the invention facilitate a convenient solution to this problem. In addition, the vertical adjustability in the spars allows the operator(s) to choose a relative elevation for the stabilizing entities (relative to the load water line of the a main hull) which gets the best work out of the stabilizing entities:—whether the main hull is stopped dead in the water, idling slowly, or else traveling rapidly as on its plane.

The combination of an adjustable suspension and a varying angle of vertical sweep provides the mutually complementary advantages of the foregoing as to provide a high degree of control over the ride of the boat, especially for planing-style main hulls. Such advantages include the combined effects of the matters that have been previously covered.

Although much has been said about the virtues of giving the spars an adjustability in the angle of the horizontal sweep, some other points merit discussion, especially after having been discovered during field trials. When the boat is laden successively with one load of a given weight and distribution in the hull, and then with a next, the capability to vary the angle of horizontal sweep allows the operator a means of handling and accommodating changes in the center of buoyancy.

Also, when the boat is heading through very large ocean waves (or being followed by very large over-taking waves), it is desirable to swing the stabilizing entities more to the side than leave them behind the stern. Otherwise they might give too much stern lift. This is to be avoided because too much stern lift might pitch or plow the bow to dive under the water surface. Another major aspect of the varying the horizontal sweep involves moving the spars to independent, non-symmetric positions. This is especially advantageous for cases when the boat is heading through very large ocean waves (or being followed by very large over-taking waves) that are not aligned perpendicular to the heading of the boat. In such cases, the boat can be set on its heading oblique to these waves, and the stabilizing entities can be swung non-symmetrically to align with the extension of the crests of the waves. That way one side won't lift while the other drops.

To return to FIGS. 19 through 22, the spar 512 includes an inventive wrist joint 520 to allow varying the attitudinal position of the stabilizing entity 510. FIG. 19 shows that the spindle 640 is aligned more or less straight up and down. However, if the spar 512 is adjusted to sweep down some slight angle, then the spindle will follow and line up off the vertical by the same angle. The wrist joint 520 allows the operator to drive the sleeve 642 that guides spindle 640 back to a vertical orientation.

As mentioned previously, the sleeve 642 is allowed some degree of drift about its top end because its bottom end is mounted in a flexible joint 644 which includes the synthetic rubber ring 648. The wrist joint 520 includes a cylinder 670 that pushes and pulls the top end of the sleeve 642 and thus allows changing the relative perpendicularity of the sleeve 642, relative the flange 644 fixed to the spar 512. The cylinder 670 is mounted longitudinally in-line with the longitudinal axis of the spar 512. The cylinder 670 has its rear end pinned to a suitable bracket 672 on the spar 512. The cylinder 670 has a piston rod 670' that has its forward end attached to a drive-collar 674 belted around the top end of the guide sleeve 642. Extension of the piston rod 670' pushes the collar 674 away, and its retraction pulls the collar 674 in towards.

However, as the spars 512 sweep horizontally, say aft of the stern, this one adjustment alone in the in-line direction of the spar 512 fails to bring the guide sleeve 642. Hence a transverse adjustment is provided for, shown by FIG. 20. A transverse-drive cylinder 680 has its rear end pinned to a suitable bracket 682 on the spar 512. The cylinder 680 has a piston rod 680' that has its forward end attached to fitting 684 in a cable 686. The cable 686 loops around an idler pulley 688 and threads through a set of a forward and rearward eyes 690. Again, the eyes 690 are fixed to the spar 512 and do not move relative to the spar. The tag ends of the cable 686 are secured to opposite fore and aft clamps 692 on the drive collar 674. Extension of the transverse-drive piston rod 680' pulls the collar 674 forward. Retraction of the transverse-drive piston rod 680' pulls the collar 674 rearward.

Figure 22:
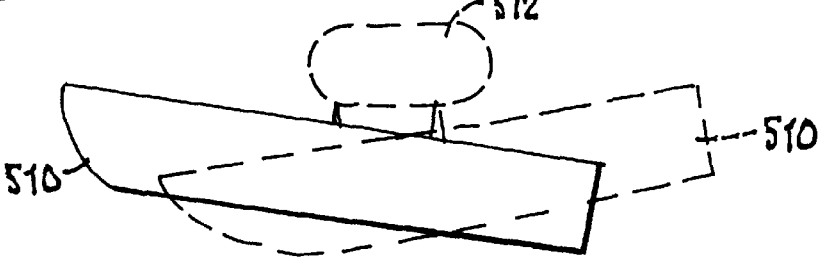
Figure 21:
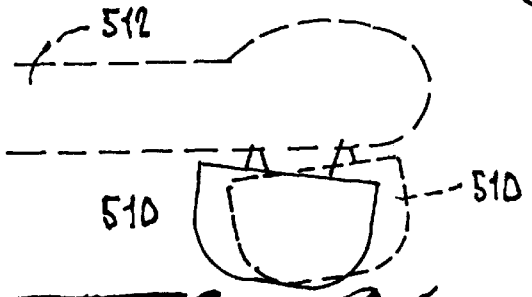
FIG. 21 is an elevational view taken in the direction of arrows XXI—XXI in FIG. 20, which shows in-line (relative to the axis of the spar) rocking of the attitude of the stabilizing entity that in this instance produces left to right tilting.
Figure 23:
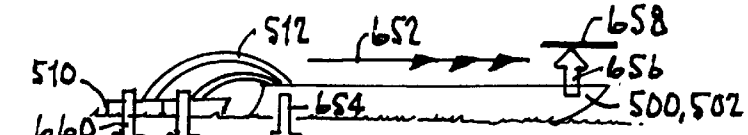

FIGS. 21 and 22 show the sum of the these effects given the following circumstance:—that the spar 512 is angled almost directly straight out to the side of the boat 500 (eg., as shown by FIG. 14). In FIG. 21, operation of the in-line drive 670 changes the attitude of stabilizing entity 510 to rock side to side as shown. FIG. 22 shows that operation of the transverse drive 680 changes the attitude of stabilizing entity 510 to pitch fore to aft as shown.

Hence the stabilizing entities can be articulated about the wrists 520 of the spars for the following advantages. That is, in order to allow a limited measure of rotational circumduction about the wrist 520, and/or to allow adjusting or varying the angle-of-attack or (aft-to-fore pitch) of the stabilizing entity. This last feature may allow affecting the local trim for the stabilizing entity.

Figure 28A:
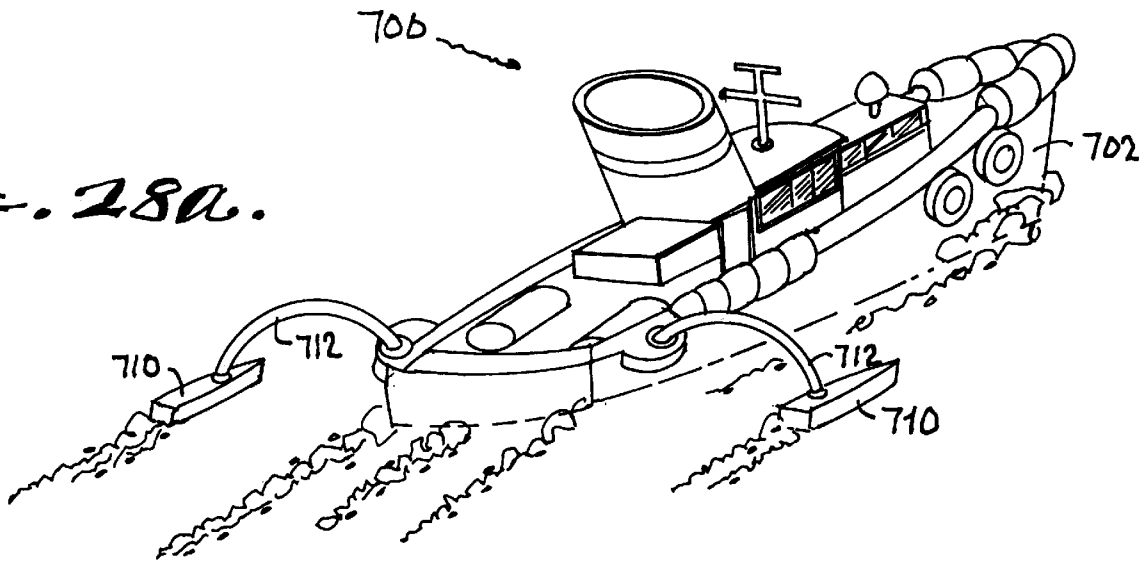
FIG. 28*a* is a perspective view of still a further embodiment of a boat with outriggers in accordance with the invention; and, FIG. 28*b* is an enlarged scale perspective view of one mini-hull thereof, to show the local steering mechanism thereof.

FIG. 28*a* is a perspective view of still a further embodiment of a boat 700 in accordance with the invention. The boat 700 is alternatively a tug boat for harbor docking duties or else a push boat for pushing barge trains. This boat 700 is a pure displacement hull type. In this boat 700, each mini-hull (eg., stabilizing entity 710) is provided with its own, onboard and local propulsion unit (not shown). This can be achieved by configuring the mini-hulls as self-contained propulsion units such as harnessed jet skis. Or else the mini-hulls can simply carry electric motors that are supplied power over conductors extending through the spars 712 from fossil-fuel fired generator sets on the main hull 702.

It is believed that widely spaced twin screws or jets ought to provide good maneuverability for a tug- or push boat. Indeed, if the mini-hulls 710 are independently steerable about their connections to the spars 712, then the widely spaced screws or jets on the mini-hulls 710 ought to give an exceptionally high degree of maneuverability.

Figure 28B:
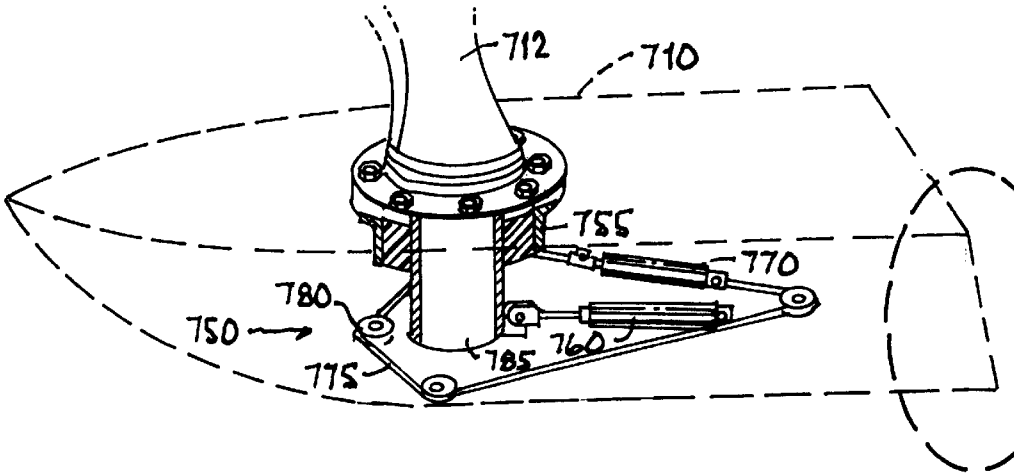

FIG. 28*b* is an enlarged scale perspective view of one mini-hull 710 thereof. It shows a local hydraulic steering mechanism 750. The mechanism 750 mimics the foregoing wrist joint 520 except inverted. It has a flange 755 likewise incorporating a synthetic rubber ring. An in-line cylinder 760 changes the fore-to-aft pitch of the mini-hull relative to the spar 712. A steering cylinder 770 drives a cable system 775 which is attached to the front end of a collar 780 on a fixed spindle 785 suspended down from the spar 712. Extension and retraction of the steering cylinder 770 causes the entire mini-hull to pivot about the fixed spindle 785 in the counter-clockwise and clockwise directions. A screw 790 is indicated in dashed lines (the screw drive is not shown). Again, it is believed that such independently steerable mini-hulls 710 providing such widely spaced screws 790 ought to give the main hull 702 an exceptionally high degree of maneuverability.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A boat having:

a main hull having a bow and a stern and opposite side beams, stabilizing entities, wherein each stabilizing entity is sized such that it displaces a substantially small fractional amount of water relative to what the main hull displaces, and is shaped and arranged such that in contact with the water under forward velocity it provides a generally upward stabilizing force through a given center of action which is transmitted by the outrigger to the main hull as an applied stabilizing moment, corresponding outriggers for the stabilizing entities, which outriggers are mounted to the main hull and extend from the main hull to distal portions formed with mounting formations, and, swivelling-mounting means for mounting each stabilizing entity to the corresponding outrigger by the mounting formations thereof in a substantially free swivelling arrangement about a generally vertical axis whereby each stabilizing, entity is afforded independence with respect to the main hull and the other stabilizing entity to change the local heading thereof to an angle that prospectively offers the least resistance.

2. The boat of claim 1, wherein the swivelling-mounting means is arranged to allow the stabilizing entities to swivel about endlessly repetitively in complete revolutions.

3. The boat of claim 1, wherein the swivelling-mounting means comprises spindles having bases attached to the stabilizing entities and mounted in the mounting formations of the outriggers for relatively free spinning.

4. The boat of claim 1, wherein the stabilizing entities comprise one of floats shaped and arranged to skim the water surface and provide such a generally upward stabilizing force which comprises a combination of buoyancy and planing forces, and, planing-style mini-hulls shaped and arranged to plane on the water surface and provide such a generally upward stabilizing force which comprises substantially planing forces.

5. The boat of claim 1, wherein the wherein the outriggers position the stabilizing entities generally outboard and rearward such that said centers of such upward stabilizing forces lie spaced substantially behind a plane containing the stern of the main hull in order to stabilize the fore-to-aft pitching as well as side-to-side rolling of the main boat hull in accordance with boat speed and wave conditions.

6. The boat of claim 1, wherein the outriggers comprise one of fixed and adjustable arrangements, the adjustable arrangement comprising adjustable mechanisms that allow adjustment of the position of the stabilizing entities among various positions of generally outboard and rearward such that said centers of such upward stabilizing forces lie spaced substantially behind a plane containing the stern of the main hull.

7. The boat of claim 1, wherein the outriggers are mounted to the main hull proximate the opposite rear corners thereof.

8. A boat having:

a main hull having a bow and a stern and opposite side beams, outriggers extending from the main hull to distal portions formed as stabilizing formations, wherein each stabilizing formation is sized such that it displaces a substantially small fractional amount of water relative to what the main hull displaces, and is shaped and arranged such that in contact with the water under forward velocity it provides a generally upward stabilizing force through a given center of action which is transmitted by the outrigger to the main hull as an applied stabilizing moment, and mounting-damping means for mounting each outrigger to the main hull as well as including damping for suppressing shocks produced by the stabilizing formations in other-than-calm water;

wherein the outriggers comprise spars, and the stabilizing formations comprise portions of the spars given one of a planing-surface shape substantially for skimming the water surface, and, an asymmetric foil shape.

9. A boat having:

a main hull having a bow and a stern and opposite side beams, outriggers extending from the main hull to distal portions formed as stabilizing formations wherein each stabilizing formation is sized such that it displaces a substantially small fractional amount of water relative to what the main hull displaces, and is shaped and arranged such that in contact with the water under forward velocity it provides a generally upward stabilizing force through a given center of action which is transmitted by the outrigger to the main hull as an applied stabilizing moment, and mountinglamiping means for mounting each outrigger to the main hull as well as including damping for suppressing shocks produced by the stabilizing formations in other-than-calm water;

wherein the stabilizing formations comprise one of floats shaped and arranged to skim the water surface and provide such an upward stabilizing force which comprises a combination of buoyancy and planing forces, planes shaped and arranged to plane on the water surface and provide such an upward stabilizing force which comprises substantially planing forces, and asymmetric foils shaped and arranged to plane the water surface or fly if submerged and provide such an upward stabilizing force which is alternatively substantially a planing force or hydrodynamic lift.

10. The boat of claim 9, wherein the damping-mounting means includes a gas-filled shock-absorbing reservoir for suppressing shocks.

11. The boat of claim 9, wherein the damping-mounting means includes a control system for varying the shock suppressing performance of the damping-mounting means between relative extremes of stiff and soggy.

12. The boat of claim 10, wherein the damping-mounting means includes a gas-filled shock-absorbing reservoir for suppressing shocks, and the control system includes a charging/venting line to the reservoir for varying the gas pressure inside the reservoir.

13. A boat having:

a main hull having a bow and a stern and opposite side beams, outriggers extending from the main hull to distal portions formed as stabilizing formations, wherein each stabilizing formation is sized such that it displaces a substantially small fractional amount of water relative to what the main hull displaces, and is shaped and arranged such that in contact with the water under forward velocity it provides a generally upward stabilizing force through a given center of action which is transmitted by the outrigger to the main hull as an applied stabilizing moment, and mounting-daping means for mounting each outrigger to the main hull as well as including damping for suppressing shocks produced by the stabilizing formations in other-than-calm water;

wherein the outriggers comprise one of fixed and adjustable arrangements, the adjustable arrangement comprising adjustable mechanisms that allow adjustment of the position of the stabilizing formations among various positions of generally outboard and rearward such that said centers of upward stabilizing force lie spaced substantially behind a plane containing the stern of the main hull.

14. The boat of claim 9, wherein the outriggers are mounted to the main hull proximate the opposite rear corners thereof.

15. A boat having:

a main hull having a bow and a stern and opposite side beams, outriggers extending from the main hull to distal portions formed as stabilizing formations, wherein each stabilizing formation is sized such that it displaces a substantially small fractional amount of water relative to what the main hull displaces, and is shaped and arranged such that in contact with the water under forward velocity it provides a generally upward stabilizing force through a given center of action which is transmitted by the outrigger to the main hull as an applied stabilizing moment, adjustment-mounting means for adjustably mounting each outrigger to the main hull to allow a user to vary and adjust the angle of vertical sweep between the main hull and outriggers through a range of relative up and down extremes for the stabilizing formations;

wherein the adjustment-mounting means is further configured with horizontal adjustment means for varying and adjusting the angle of horizontal sweep between the main hull and outriggers through a range of relative fore and aft extremes for the stabilizing formations, including positions for the stabilizing formations among which are generally outboard and rearward such that said centers of the upward stabilizing force lie spaced substantially behind a plane containing the stern of the main hull in order to stabilize the fore-to-aft pitching as well as side-to-side rolling of the main boat hull in accordance with boat speed and wave conditions.

16. The boat of claim 15, wherein the adjustment-mounting means includes power drive means for varying and adjusting the angle of vertical sweep by a mechanical power drive system.

17. The boat of claim 16, wherein the adjustment-mounting means includes other power drive means for varying and adjusting the angle of horizontal sweep by a mechanical power drive system.

18. The boat of claim 17, wherein both power drive means include hydraulic cylinders to mechanically vary and adjust the angle of vertical and/or horizontal sweep.

19. A boat having:

a main hull having a bow and a stern and opposite side beams, outriggers extending from the main hull to distal portions formed as stabilizing formations, wherein each stabilizing formation is sized such that it displaces a substantially small fractional amount of water relative to what the main hull displaces, and is shaped and arranged such that in contact with the water under forward velocity it provides a generally upward stabilizing force through a given center of action which is transmitted by the outrigger to the main hull as an applied stabilizing moment, adjustment-mounting means for adjustably mounting each outrigger to the main hull to allow a user to vary and adjust the angle of vertical sweep between the main hull and outrigge through a range of relative up and down extremes for the stabilizing formations;

wherein the outriggers comprise spars, and the stabilizing formations comprise portions of the spars given one of a planing-surface shape substantially for skimming the water surface, and, an asymmetric foil shape.

20. A boat having:

a main hull having a bow and a stern and opposite side beams, outriggers extending from the main hull to distal portions formed as stabilizing formations, wherein each stabilizing formation is sized such that it displaes a substantially small fractional amount of water relative to what the main hull displaces, and is shaped and arranged such that in contact with the water under forward velocity it provides a generally upward stabilizing force through a given center of action which is transmitted by the outrigger to the main hull as an applied stabilizing moment, adjustment-mounting means for adjustably mounting each outrigger to the main hull to allow a user to vary and adjust the angle of vertical sweep between the main hull and outriggers through a range of relative up and down extremes for the stabilizing formations;

wherein the stabilizing formations comprise one of floats shaped and arranged to skim the water surface and provide an upward stabilizing force which comprises a combination of buoyancy and planing forces, planes shaped and arranged to plane on the water surface and provide an upward stabilizing force which comprises substantially planing forces, and asymmetric foils shaped and arranged to plane the water surface or fly if submerged and provide an upward stabilizing force which is alternatively substantially a planing force or hydrodynamic lift.

21. The boat of claim 20, wherein the outriggers are mounted to the main hull proximate the opposite rear corners thereof.

22. The boat of claim 20, wherein the adjustment-mounting means further includes damping means for damping or suppressing shocks produced by the stabilizing formations in other-than-calm water.

23. The boat of claim 20, wherein the adjustment-mounting means includes a power drive system to allow an operator to vary and adjust the angle of vertical sweep by means of controls for the power drive system.

24. The boat of claim 23, wherein the power drive system includes hydraulic cylinders to mechanically vary and adjust the angle of vertical sweep.

* * * * *